US011647802B2

(12) United States Patent
Lotti

(10) Patent No.: US 11,647,802 B2
(45) Date of Patent: May 16, 2023

(54) CASES FOR STORING LASH EXTENSIONS AND METHODS FOR USE AND MANUFACTURE THEREOF

(71) Applicant: Lashify, Inc., Los Angeles, CA (US)

(72) Inventor: Sahara Lotti, Los Angeles, CA (US)

(73) Assignee: Lashify, Inc., North Hollywood, CA (US)

( * ) Notice: Subject to any disclaimer, the term of this patent is extended or adjusted under 35 U.S.C. 154(b) by 577 days.

(21) Appl. No.: 16/644,948

(22) PCT Filed: Oct. 19, 2019

(86) PCT No.: PCT/US2019/057104
§ 371 (c)(1),
(2) Date: Mar. 5, 2020

(87) PCT Pub. No.: WO2020/082058
PCT Pub. Date: Apr. 23, 2020

(65) Prior Publication Data

US 2021/0161265 A1 Jun. 3, 2021

Related U.S. Application Data

(60) Provisional application No. 62/748,335, filed on Oct. 19, 2018.

(51) Int. Cl.

| | |
|---|---|
| ***A41G 5/02*** | (2006.01) |
| ***A45C 11/00*** | (2006.01) |
| *B65D 85/00* | (2006.01) |

(52) U.S. Cl.
CPC ..... *A41G 5/02* (2013.01); *A45C 11/008* (2013.01); *B65D 85/00* (2013.01)

(58) Field of Classification Search
CPC ..... A41G 5/02; A45C 11/008
See application file for complete search history.

(56) References Cited

U.S. PATENT DOCUMENTS

| | | | |
|---|---|---|---|
| 1,831,801 | A | 11/1931 | Birk |
| 1,920,401 | A | 8/1933 | Kahn |
| D101,791 | S | 11/1936 | Rauh |
| D129,526 | S | 9/1941 | Hanisch |
| 2,268,082 | A | 12/1941 | Phillips, Sr. |
| 2,323,595 | A | 7/1943 | Hanisch |

(Continued)

FOREIGN PATENT DOCUMENTS

| | | | |
|---|---|---|---|
| CN | 102975141 | A | 3/2013 |
| CN | 303086463 | | 1/2015 |

(Continued)

OTHER PUBLICATIONS

Translation of Nedelec, EP 1839526, Oct. 2007.*

(Continued)

*Primary Examiner* — Rachel R Steitz
*Assistant Examiner* — Brianne E Kalach
(74) *Attorney, Agent, or Firm* — Lowenstein Sandler LLP

(57) ABSTRACT

A case includes a lit, a gasket, and a body coupled to the lid such that the body and the lid define a window and such that the gasket is positioned between the lid and body. The window is configured to enable a lash extension having a base and a plurality of hairs that extend out the window as the gasket resiliently contacts the base or the hairs.

23 Claims, 29 Drawing Sheets

(56) References Cited

U.S. PATENT DOCUMENTS

| | | | |
|---|---|---|---|
| 2,392,694 | A | 1/1946 | Rector |
| D154,227 | S | 6/1949 | Alvizua |
| D155,559 | S | 10/1949 | Tillmann |
| 2,618,279 | A | 11/1952 | Reiffert |
| D189,888 | S | 3/1961 | Tapper |
| 3,016,059 | A | 1/1962 | Hutton |
| 3,343,552 | A | 9/1967 | Steffen |
| 3,454,015 | A | 7/1969 | Udes |
| 3,478,754 | A | 11/1969 | Martin, Jr. |
| 3,547,135 | A | 12/1970 | Roos |
| 3,557,653 | A | 1/1971 | Kim |
| 3,561,454 | A | 2/1971 | O'connell |
| 3,625,229 | A | 12/1971 | Silson |
| 3,645,281 | A | 2/1972 | Seidler |
| 3,670,742 | A | 6/1972 | Weaner |
| 3,703,180 | A | 11/1972 | Aylott |
| 3,828,803 | A | 8/1974 | Windsor |
| 3,833,007 | A | 9/1974 | Jacobs |
| 3,900,038 | A | 8/1975 | Masters |
| D240,769 | S | 7/1976 | Bowman |
| 4,018,336 | A | 4/1977 | Aylott |
| 4,203,518 | A | 5/1980 | Current |
| 4,299,242 | A | 11/1981 | Choe |
| 4,395,824 | A | 8/1983 | Puro |
| D270,551 | S | 9/1983 | Thayer |
| D280,354 | S | 8/1985 | Bakic |
| D281,259 | S | 11/1985 | Hensley |
| D281,825 | S | 12/1985 | Bakic |
| 4,697,856 | A | 10/1987 | Abraham |
| D298,070 | S | 10/1988 | Ferrari |
| D299,561 | S | 1/1989 | Bakic |
| D301,371 | S | 5/1989 | Kaprelian |
| D302,602 | S | 8/1989 | Bakic |
| D314,066 | S | 1/1991 | Bakic |
| D318,346 | S | 7/1991 | Bakic |
| 5,033,626 | A | 7/1991 | Platti |
| D328,246 | S | 7/1992 | Nottingham et al. |
| D342,671 | S | 12/1993 | Elliott |
| D343,340 | S | 1/1994 | Frye, Jr. |
| D348,219 | S | 6/1994 | Goldberg |
| 5,322,166 | A | 6/1994 | Crowther |
| 5,377,700 | A | 1/1995 | Harris |
| D358,312 | S | 5/1995 | Keenan |
| D358,908 | S | 5/1995 | Rawski |
| D368,495 | S | 4/1996 | Rypinski |
| D373,726 | S | 9/1996 | Power |
| 5,571,543 | A | 11/1996 | Song |
| D379,923 | S | 6/1997 | De Baschmakoff |
| D380,616 | S | 7/1997 | Leslie |
| D382,198 | S | 8/1997 | Mulhauser |
| D386,808 | S | 11/1997 | Litton |
| D387,483 | S | 12/1997 | Sloan |
| D388,549 | S | 12/1997 | Mouyiaris |
| D397,040 | S | 8/1998 | Bakic |
| D403,922 | S | 1/1999 | Terraccino |
| D404,531 | S | 1/1999 | Bakic et al. |
| 5,896,996 | A | 4/1999 | Chuang |
| D411,649 | S | 6/1999 | Bakic |
| D418,018 | S | 12/1999 | Winsted |
| D418,253 | S | 12/1999 | Bakic |
| 6,003,467 | A | 12/1999 | Shelton-Ferrell |
| 6,032,609 | A | 3/2000 | Luoma |
| 6,092,291 | A | 7/2000 | Cendoma |
| D437,086 | S | 1/2001 | Dickert |
| 6,182,839 | B1 | 2/2001 | Robbins |
| D442,304 | S | 5/2001 | Huang |
| 6,230,715 | B1 | 5/2001 | Cho |
| D443,471 | S | 6/2001 | Lillelund et al. |
| 6,174,321 | B1 | 6/2001 | Webb |
| 6,265,010 | B1 | 7/2001 | Franco |
| D448,927 | S | 10/2001 | Vazquez |
| D452,151 | S | 12/2001 | Scott |
| D454,981 | S | 3/2002 | Lamagna |
| D456,077 | S | 4/2002 | Etter |
| D456,097 | S | 4/2002 | Lamagna |
| D458,413 | S | 6/2002 | Boilen |
| 6,439,406 | B1 | 8/2002 | Duhon |
| D463,280 | S | 9/2002 | Brozell |
| D463,744 | S | 10/2002 | Brozell |
| D464,565 | S | 10/2002 | Weinstein |
| D464,877 | S | 10/2002 | Weinstein |
| 6,471,515 | B2 | 10/2002 | Feuer |
| D467,800 | S | 12/2002 | Chen |
| 6,530,379 | B2 | 3/2003 | Iosilevich |
| D472,675 | S | 4/2003 | Lamagna |
| D472,810 | S | 4/2003 | Gelardi |
| D473,106 | S | 4/2003 | Scherer |
| 6,567,640 | B2 | 5/2003 | Ishikawa |
| D475,616 | S | 6/2003 | Lambrecht |
| D479,365 | S | 9/2003 | Todeschini |
| D480,864 | S | 10/2003 | Sayers |
| D481,946 | S | 11/2003 | Nicholson |
| D481,952 | S | 11/2003 | Orsomando |
| D482,495 | S | 11/2003 | Jackel-Marken |
| D482,928 | S | 12/2003 | Liu |
| D482,934 | S | 12/2003 | Liu |
| D483,232 | S | 12/2003 | Liu |
| D483,633 | S | 12/2003 | Jansson |
| D483,909 | S | 12/2003 | Todeschini |
| D485,359 | S | 1/2004 | McMichael |
| D488,353 | S | 4/2004 | Govrik |
| D488,618 | S | 4/2004 | Wekstein |
| D490,932 | S | 6/2004 | Mammone |
| D491,336 | S | 6/2004 | Cecere |
| D495,834 | S | 9/2004 | Todeschini |
| D496,759 | S | 9/2004 | Rodriguez |
| D501,580 | S | 2/2005 | Sugawara |
| D506,573 | S | 6/2005 | de Grandcourt |
| D507,678 | S | 7/2005 | Lamagna |
| D509,942 | S | 9/2005 | Connolly |
| D512,913 | S | 12/2005 | Gauthier |
| 6,981,814 | B2 | 1/2006 | Geardino et al. |
| D515,242 | S | 2/2006 | Cho |
| D516,247 | S | 2/2006 | Merheje |
| 7,000,775 | B2 | 2/2006 | Gelardi |
| D522,376 | S | 6/2006 | Hales |
| 7,128,213 | B2 | 10/2006 | Tung |
| D532,891 | S | 11/2006 | Buthier et al. |
| D533,650 | S | 12/2006 | Ohta |
| 7,147,127 | B2 | 12/2006 | Lepke |
| D534,426 | S | 1/2007 | Bakic |
| 7,159,720 | B2 | 1/2007 | Pearson |
| D537,208 | S | 2/2007 | Shaljian |
| D540,112 | S | 4/2007 | Nichols |
| D543,662 | S | 5/2007 | Bivona |
| D543,815 | S | 6/2007 | Metcalf |
| D543,850 | S | 6/2007 | Legros |
| D544,148 | S | 6/2007 | Bivona |
| D544,202 | S | 6/2007 | Markfelder |
| D545,396 | S | 6/2007 | Casey |
| 7,228,863 | B2 | 6/2007 | Dumler |
| D546,002 | S | 7/2007 | Bowen |
| D547,940 | S | 8/2007 | Sandy |
| D561,045 | S | 2/2008 | Lee |
| D561,942 | S | 2/2008 | Khubani |
| D563,157 | S | 3/2008 | Bouveret |
| D563,616 | S | 3/2008 | Lynde |
| D563,728 | S | 3/2008 | Welch, III |
| D569,041 | S | 5/2008 | Azoulay |
| D569,553 | S | 5/2008 | Cho |
| 7,374,048 | B2 | 5/2008 | Mazurek |
| D571,543 | S | 6/2008 | Sungadi |
| D573,308 | S | 7/2008 | Wittke-Kothe |
| D575,904 | S | 8/2008 | Iqbal |
| D579,059 | S | 10/2008 | Chan |
| D584,449 | S | 1/2009 | Shaljian |
| D587,529 | S | 3/2009 | Pratt |
| D588,746 | S | 3/2009 | Ross |
| D591,599 | S | 5/2009 | Okin et al. |
| D592,923 | S | 5/2009 | Konopka |
| D595,054 | S | 6/2009 | Whitaker |
| 7,543,718 | B2 | 6/2009 | Simon |
| D600,441 | S | 9/2009 | Estrada |
| D602,354 | S | 10/2009 | Dibnah et al. |

(56) References Cited

U.S. PATENT DOCUMENTS

D604,579 S 11/2009 Robinson
D605,514 S 12/2009 Weber
D607,332 S 1/2010 Huntington et al.
D615,290 S 5/2010 Heffner
D617,187 S 6/2010 Murray
D617,943 S 6/2010 Bouix
D618,078 S 6/2010 Cripps
7,748,391 B2 7/2010 Vance
D627,103 S 11/2010 Cho
D631,606 S 1/2011 Chen
7,896,192 B2 3/2011 Conley
D638,733 S 5/2011 Sullivan
D639,196 S 6/2011 Sullivan
D640,005 S 6/2011 Lee
D640,834 S 6/2011 Chen
D647,799 S 11/2011 Dunwoody
D650,669 S 12/2011 Dunwoody
D650,670 S 12/2011 Dunwoody
D651,082 S 12/2011 Dunwoody
D657,496 S 4/2012 Flatt
D657,696 S 4/2012 Floyd
D659,330 S 5/2012 Davis
D661,185 S 6/2012 Battat
D661,599 S 6/2012 Floyd et al.
8,196,591 B2 6/2012 Lee
8,205,761 B2 6/2012 Stull, Sr.
D663,113 S 7/2012 Simms
D664,011 S 7/2012 Affonso
8,225,800 B2 * 7/2012 Byrne ..... A41G 5/02 132/216
D669,223 S 10/2012 Lee
D670,030 S 10/2012 Nguyen
D673,325 S 12/2012 Martines
D679,590 S 4/2013 Stull, Sr.
D679,591 S 4/2013 Stull, Sr.
D679,592 S 4/2013 Stull, Sr.
D679,595 S 4/2013 Stull, Sr.
D679,596 S 4/2013 Stull, Sr.
D682,103 S 5/2013 Jedlicka
D682,688 S 5/2013 Murray
D686,495 S 7/2013 Murray
D690,419 S 9/2013 Porat
8,567,640 B1 10/2013 Johnson-Lofton
8,596,284 B2 12/2013 Byrne
D698,078 S 1/2014 Purizhansky et al.
8,657,170 B2 2/2014 Martinez
D700,799 S 3/2014 Ludeman et al.
D702,510 S 4/2014 Segal
8,701,685 B2 4/2014 Chipman
D707,392 S 6/2014 Yu
D707,556 S 6/2014 Kawamura
D709,129 S 7/2014 Moertl
D711,227 S 8/2014 Sheikh
D713,217 S 9/2014 Micara-Sartori
D714,494 S 9/2014 Vasquez
D716,498 S 10/2014 Wolff
D717,038 S 11/2014 Lee
8,881,741 B1 11/2014 Mattson
8,881,744 B2 11/2014 Mckinstry
8,939,159 B2 1/2015 Yeo
9,004,299 B2 4/2015 Hardin
D738,579 S 9/2015 Owens
D738,611 S 9/2015 Gupta
D746,046 S 12/2015 Lee
9,215,901 B1 12/2015 Schroeder
D751,904 S 3/2016 Landrum
9,277,777 B2 3/2016 Lee
9,284,111 B2 3/2016 Huang
D753,455 S 4/2016 Hyma
D753,881 S 4/2016 Hussain
9,314,085 B2 4/2016 Hatch
D755,577 S 5/2016 Segal
D757,274 S 5/2016 Gelb
D758,009 S 5/2016 Berkos
9,351,752 B2 5/2016 Slavin
D761,489 S 7/2016 Krakovszki
D762,433 S 8/2016 Yang
D764,688 S 8/2016 Robinson et al.
9,451,800 B2 9/2016 Dinh
9,504,285 B2 11/2016 Lin
D773,915 S 12/2016 Barakat
D775,270 S 12/2016 Moffat
D783,899 S 4/2017 Roh
D783,901 S 4/2017 Kim
D784,615 S 4/2017 Choi
D788,556 S 6/2017 James
D796,582 S 9/2017 Beard
D800,966 S 10/2017 Silva
D806,315 S 12/2017 Hardwick
D810,534 S 2/2018 Liu
D810,543 S 2/2018 Astradsson
D811,872 S 3/2018 Wu
D814,107 S 3/2018 Lotti
D817,132 S 5/2018 Yang
9,993,373 B2 6/2018 Nassif et al.
D823,538 S 7/2018 Ruggaber
D823,683 S 7/2018 Caldwell
D825,333 S 8/2018 Ozamiz et al.
D828,013 S 9/2018 van Wijngaarden
D828,014 S 9/2018 van Wijngaarden
D828,629 S 9/2018 Hussain
D829,381 S 9/2018 Kim
D830,170 S 10/2018 Holmes
D832,701 S 11/2018 Oates
D832,702 S 11/2018 Oates
D835,465 S 12/2018 Son
D836,432 S 12/2018 Riedel et al.
10,149,528 B2 12/2018 Erickson
D836,943 S 1/2019 Klieman
D837,653 S 1/2019 Meranus
10,264,837 B2 4/2019 Park
D847,631 S 5/2019 Villbrandt
D847,632 S 5/2019 Villbrandt
D848,795 S 5/2019 Butler
D850,715 S 6/2019 Lotti
D852,412 S 6/2019 Grund
10,362,823 B1 7/2019 Hill
D863,419 S 10/2019 Oguma
D863,679 S 10/2019 Lotti
D867,664 S 11/2019 Lotti
D867,668 S 11/2019 Lotti
10,479,566 B2 11/2019 Doyle
D871,673 S 12/2019 Qureshi
10,532,861 B2 1/2020 Kimmel
D877,416 S 3/2020 Lotti
D890,430 S 7/2020 Lotti
D895,201 S 9/2020 Lotti
D895,958 S 9/2020 Guo
10,892,048 B2 1/2021 Reddy
D914,965 S 3/2021 Lotti
D917,153 S 4/2021 Denei
D918,475 S 5/2021 Hu
D920,400 S 5/2021 Saito
D920,465 S 5/2021 Bould
D930,788 S 9/2021 Roth
D932,101 S 9/2021 Davis
11,219,260 B2 1/2022 Lotti
D955,635 S 6/2022 Lotti
D955,645 S 6/2022 Lotti
2002/0094507 A1 7/2002 Feuer
2003/0005941 A1 1/2003 Iosilevich
2003/0111467 A1 6/2003 Norman
2003/0155317 A1 8/2003 McNeeley
2004/0011372 A1 1/2004 Park
2005/0061341 A1 3/2005 Choe
2005/0166939 A1 8/2005 Stroud
2006/0124658 A1 6/2006 Coe
2006/0129187 A1 6/2006 Cho
2006/0142693 A1 6/2006 Kahen
2007/0050207 A1 3/2007 Merszei
2007/0084749 A1 4/2007 Demelo
2007/0227550 A1 10/2007 Merszei
2007/0272264 A1 11/2007 Byrne
2008/0196732 A1 8/2008 Merszei

(56) References Cited

U.S. PATENT DOCUMENTS

| | | | | |
|---|---|---|---|---|
| 2009/0028625 | A1 | 1/2009 | Bonneyrat | |
| 2009/0217939 | A1 | 9/2009 | Rabe et al. | |
| 2010/0170526 | A1 | 7/2010 | Nguyen | |
| 2011/0079236 | A1 | 4/2011 | Lee | |
| 2011/0290271 | A1 | 12/2011 | Rabe | |
| 2012/0055499 | A1 | 3/2012 | Sanbonmatsu | |
| 2012/0305020 | A1 | 12/2012 | Byrne | |
| 2013/0110032 | A1 | 5/2013 | Luzon | |
| 2013/0255706 | A1 | 10/2013 | Dinh | |
| 2013/0298931 | A1 | 11/2013 | Samain | |
| 2013/0320025 | A1 | 12/2013 | Mazzetta | |
| 2013/0333714 | A1 | 12/2013 | Merszei | |
| 2014/0110304 | A1 | 4/2014 | Wu | |
| 2015/0114421 | A1 | 4/2015 | Pham | |
| 2015/0136162 | A1 | 5/2015 | Brouillet et al. | |
| 2015/0173442 | A1 | 6/2015 | Raouf | |
| 2015/0216246 | A1 | 8/2015 | Ahn et al. | |
| 2016/0016702 | A1 | 1/2016 | Siskindovich | |
| 2016/0037848 | A1 | 2/2016 | Lee | |
| 2016/0219959 | A1 | 8/2016 | Chipman | |
| 2016/0324242 | A1 | 11/2016 | Hansen | |
| 2016/0345648 | A1 | 12/2016 | Miniello | |
| 2016/0353821 | A1 | 12/2016 | Calina | |
| 2017/0112214 | A1 | 4/2017 | Ahn | |
| 2017/0112264 | A1 | 4/2017 | Park | |
| 2017/0358245 | A1 | 12/2017 | Dana | |
| 2018/0065779 | A1* | 3/2018 | Chiba | A45D 42/00 |
| 2018/0098591 | A1 | 4/2018 | Leeflang | |
| 2018/0160755 | A1 | 6/2018 | Hansen et al. | |
| 2018/0242672 | A1 | 8/2018 | Lotti | |
| 2018/0242715 | A1 | 8/2018 | Lotti | |
| 2018/0352885 | A1 | 12/2018 | Kim | |
| 2018/0352886 | A1 | 12/2018 | Schroeder | |
| 2019/0133227 | A1 | 5/2019 | Le | |
| 2019/0191851 | A1 | 6/2019 | Esposito | |
| 2020/0260839 | A1 | 8/2020 | Lotti | |
| 2021/0030140 | A1 | 2/2021 | Chico | |

FOREIGN PATENT DOCUMENTS

| | | | |
|---|---|---|---|
| CN | 104363790 | A | 2/2015 |
| CN | 305719777 | | 4/2020 |
| CN | 305738664 | | 4/2020 |
| CN | 305916370 | | 7/2020 |
| EP | 1839526 | * | 10/2007 |
| EP | 1839526 | | 7/2009 |
| GB | 1042020 | * | 9/1966 |
| GB | 1042020 | A | 9/1966 |
| GB | 1307107 | A | 12/1970 |
| GB | 6024289 | | 12/2017 |
| JP | 2011-177395 | | 9/2011 |
| JP | 2011177395 | A | 9/2011 |
| JP | 2015105447 | A | 6/2015 |
| JP | 3201846 | U | 1/2016 |
| JP | 2016163699 | A | 9/2016 |
| KR | 200165452 | Y1 | 2/2000 |
| KR | 20020065306 | A | 8/2002 |
| KR | 20090010717 | | 1/2009 |
| KR | 20090010717 | U | 10/2009 |
| KR | 101336422 | B1 | 12/2013 |
| KR | 300906653 | | 5/2017 |
| RU | 2423058 | C1 | 7/2011 |
| WO | 2018002914 | A1 | 1/2018 |
| WO | WO2018/022914 | | 1/2018 |
| WO | 2018119034 | A1 | 6/2018 |

OTHER PUBLICATIONS

Cruiser Portable Speaker, NYNE, published atthegamerwithkids.com, posted by Sam Versionone on Apr. 6, 2015 © not listed, https://thegamerwithkids.com/2015/04/06/nyne-cruiser-review-a-wireless-speaker-for-your-bicycle/, downloaded from internet Jun. 20, 2018.

Hongjun web page, https://detail.1688.com/offer/574685154983.html?spm=a2615.7691456.newlist.75.22f96dc5Msy00t, downloaded from internet Oct. 31, 2018 (16 pages).

International Search Report and Written Opinion dated Dec. 19, 2019 in related PCT/2019/057104 filed Oct. 19, 2019 (8 pages).

International Search Report and Written Opinion dated Mar. 12, 2018 in related PCT/2017/067513 filed Dec. 20, 2017 (10 pages).

MAC Cosmetics, 34 Lash, http://www.bornprettystore.com/false-eyelashes-thick-natural-simulation-recyclable-curly-false-eyelash-makeup-cosmetic-tools-p-44675.html, downloaded from internet Feb. 14, 2019 (1 page).

MAC Cosmetics, 34 Lash, http://www.bornpretty/store.com/fa!sa-eyelashes-thick-natural-simulation-recyclable-curly-false-eyelash-makeup-cosmetic-tools-p-44675.hlml, downloaded from internet Feb. 14, 2019 (1 page).

Lashify Gossamer Lash Cartridge https://lashify.com/collections/shop-1/products/gossamer-eye-lozenge-c-style?variant=783670738950, downloaded from internet Jun. 15, 2018 (2 pages).

Cruiser Portable Speaker, NYNE, published at thegamerwithkids.com, posted by Sam Versionone on Apr. 6, 2015 © not listed, online, cite visited Jun. 20, 2018. Available from Internet. URL: https://thegamerwithkids.com/2015/04/06/nyne-cruiser-review-a-wireless-speaker-for-your-bycicle/ (Year: 2015).

Yoyo PillBox, Alessi, amazon.com, published by Alessi on Nov. 20, 2018 © 1996-2020 Amazon.com, online, site visited Aug. 6, 2020. Available at URL: https://www.amazon.com/Alessi-Stainless-Steel-Michel-Bouquillon/dp/B07KKFQNQ6 (Year: 2018).

Hongjun web page, https://detail.1686.com/offer/574685154963.html?spm=a2615.7691456.newlist.75.22f96dc5Msy00t, downloaded from internet Oct. 31, 2018 (16 pages).

Buzludzha Monument, Gueorguy Stoilov circa 1980, justanotherbackpacker.com, published by blogger Rich on Apr. 29, 2014 © 2019, online, site visited Aug. 27, 2019. Downloaded from Internet, URL: http://www.justanotherbackpacker.com/ buzludzha-monument-bulgaria-ufo/ (Year: 2014).

Peonies and Lilies, Bourjois 2 in 1 Tweezers and Faux & Fabulous Eyelashes, posted Oct. 24, 2012 (2 pages).

Locking Automated Medication Dispenser, StaarAlert, Starralert.com, autor unlisted, published on Aug. 14, 2020 per wayback machine 2020 Staar Altelt, online, site visted Feb. 19, 2021. Available at URL:https://www.staaralert.com/locking-medicalion-dispenser (Year: 2020).

Cartridge, Lashify, Allure.com, published by Salbe Yong on Oct. 10, 2018 2021 Conde Nast, online, site visted on Feb. 17, 2021. Available at URL: https://allure.com/story/lashify-false-eyelashes-review-photos (Year: 2018).

Eyelash Holder, Vant Guard Beauty, facebook.com, author unlisted, published on Aug. 12, 2020 unlisted, online site visited Oct. 5, 2022. Available at URL: https://www.facebook.com/photo?fbid=162270508866790&set=a.161502768943564 (Year 2020).

Eyelash Packing Cirle Box, Maitys, amazon.co.u k, published by Maitys, first available Jun. 23, 2020 1996-2021 Amazon.com, Inc. online, site visisted Oct. 25, 2021. Available from Internet, URL https://www.amazon.co.uk/piece-Eyelash-Packaging-Circle-Storage/dp/B08BNZ5GQQ?th=1 (year 2020).

"Born Pretty, False Eyelashes Thick Natural Simulation Recyclable Curly False Eyelash Makeup Cosmetic Tools, http://www.bornprettystore.com/false-eyelashes-thick-natural-simulation-recyclable-curly-false-eyelash-makeup-cosmetic-tools-p-44675.html downloaded from internet Oct. 18, 2018 (6 pages).".

International Search Report and Written Opinion dated Dec. 19, 2019 in related PCT/2019/057104.

International Search Report and Written Opinion dated Mar. 12, 2018 in related PCT/US2017/067513 filed Dec. 20, 2017 (10 pages).

International Search Report and Written Opinion dated Nov. 27, 2017 in related PCT/US2017/044217 filed Jul. 27, 2017 (10 pages).

* cited by examiner

CASES FOR STORING LASH EXTENSIONS AND METHODS FOR USE AND MANUFACTURE THEREOF

CROSS REFERENCE TO RELATED APPLICATIONS

The present application claims the benefit of priority to International Patent Application PCT/US2019/057104 filed 19 Oct. 2019; which claims a benefit of U.S. Provisional Application Ser. No. 62/748,335 filed 19 Oct. 2018; the contents of which is incorporated herein by reference in its entirety

TECHNICAL FIELD

This disclosure relates to cases for storing lash extensions.

BACKGROUND

A lash extension can be stored in a case. However, the lash extension can be displaced from the case during transport, which can damage the lash extension or result in the lash extension being lost.

SUMMARY

Broadly, this disclosure enables various cases for storing lash extensions and methods of use and manufacture thereof. In particular, these cases can include gaskets or inclined floors, which can help the lash extensions to avoid being displaced from the case during transport.

In an embodiment, a case comprises: a lid; a gasket; a body coupled to the lid such that the body and the lid define a window and such that the gasket is positioned between the lid and the body, the window being configured to enable a lash extension having a base and a plurality of hairs extend out of the window as the gasket resiliently contacts the base or the hairs.

One embodiment of a method of manufacturing a case for carrying artificial eyelash extensions may include providing a lid, providing a gasket, and providing a body. The lid may be coupled to the body such that the body and the lid define a window. The gasket may be coupled to either the lid or the body between the lid and the body, where the window may be configured to enable a lash extension having a base and a plurality of hairs that extend out of the window as the gasket resiliently contacts the base or the hairs.

DETAILED DESCRIPTION

Broadly, this disclosure enables various cases for storing lash extensions and methods of use and manufacture thereof.

In particular, these cases can include gaskets or inclined floors, which can help the lash extensions to avoid being displaced from the case during transport.

Figure 7:
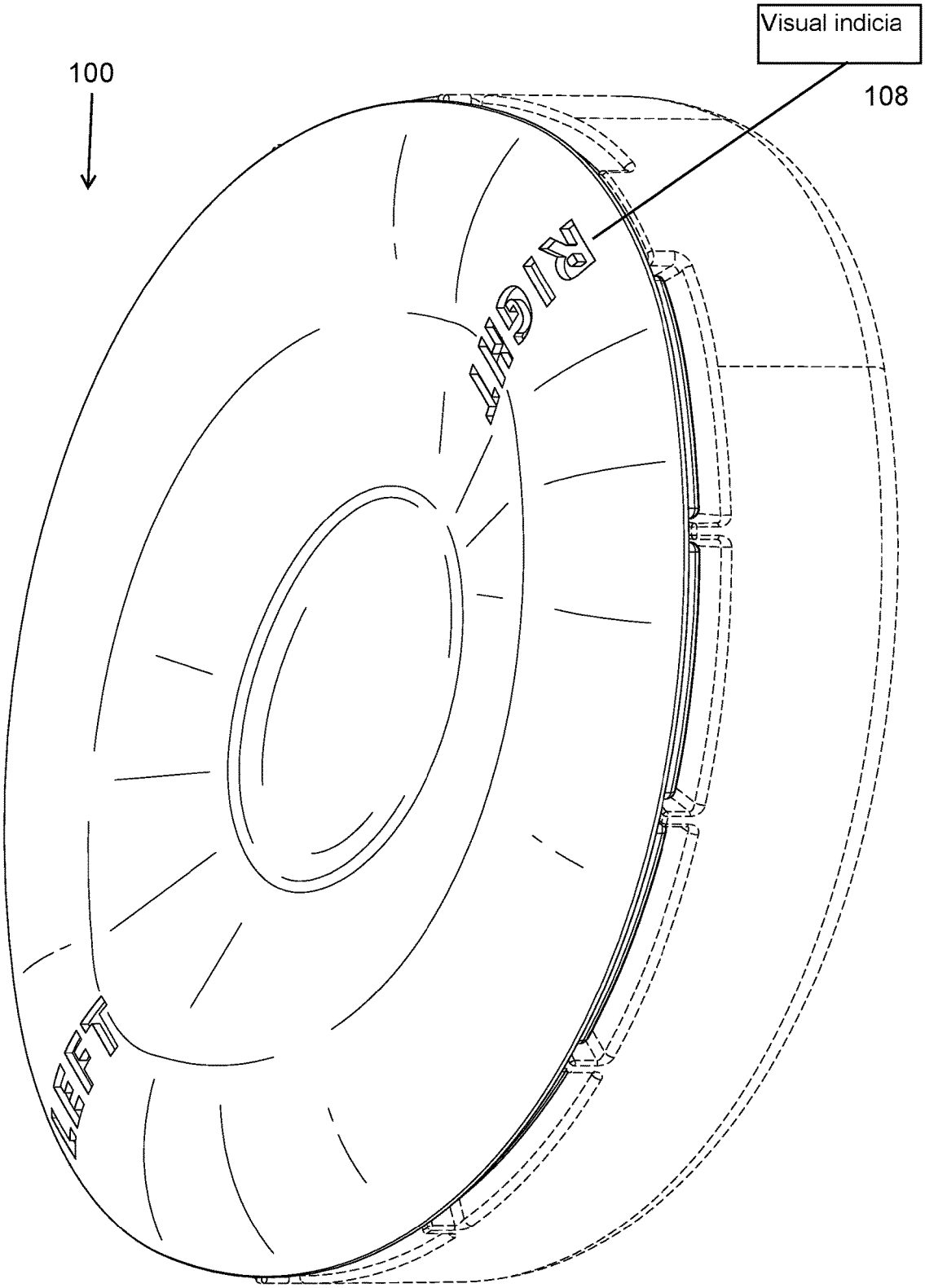
FIG. 7 shows an embodiment of a lid hosting a visual indicia thereon according to this disclosure.
Figure 8:
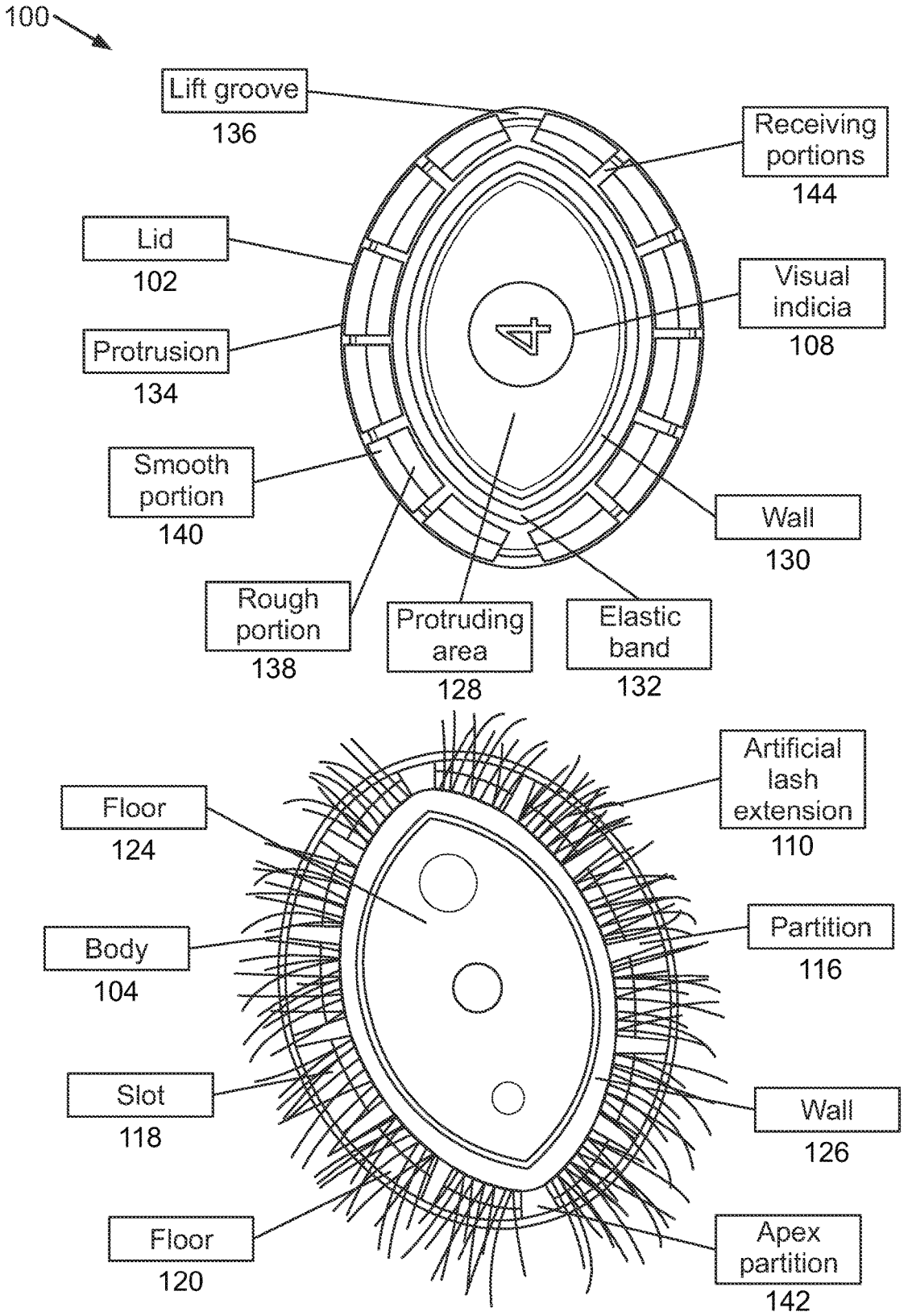
FIG. 8 shows an embodiment of a lid and a body according to this disclosure.
Figure 9:
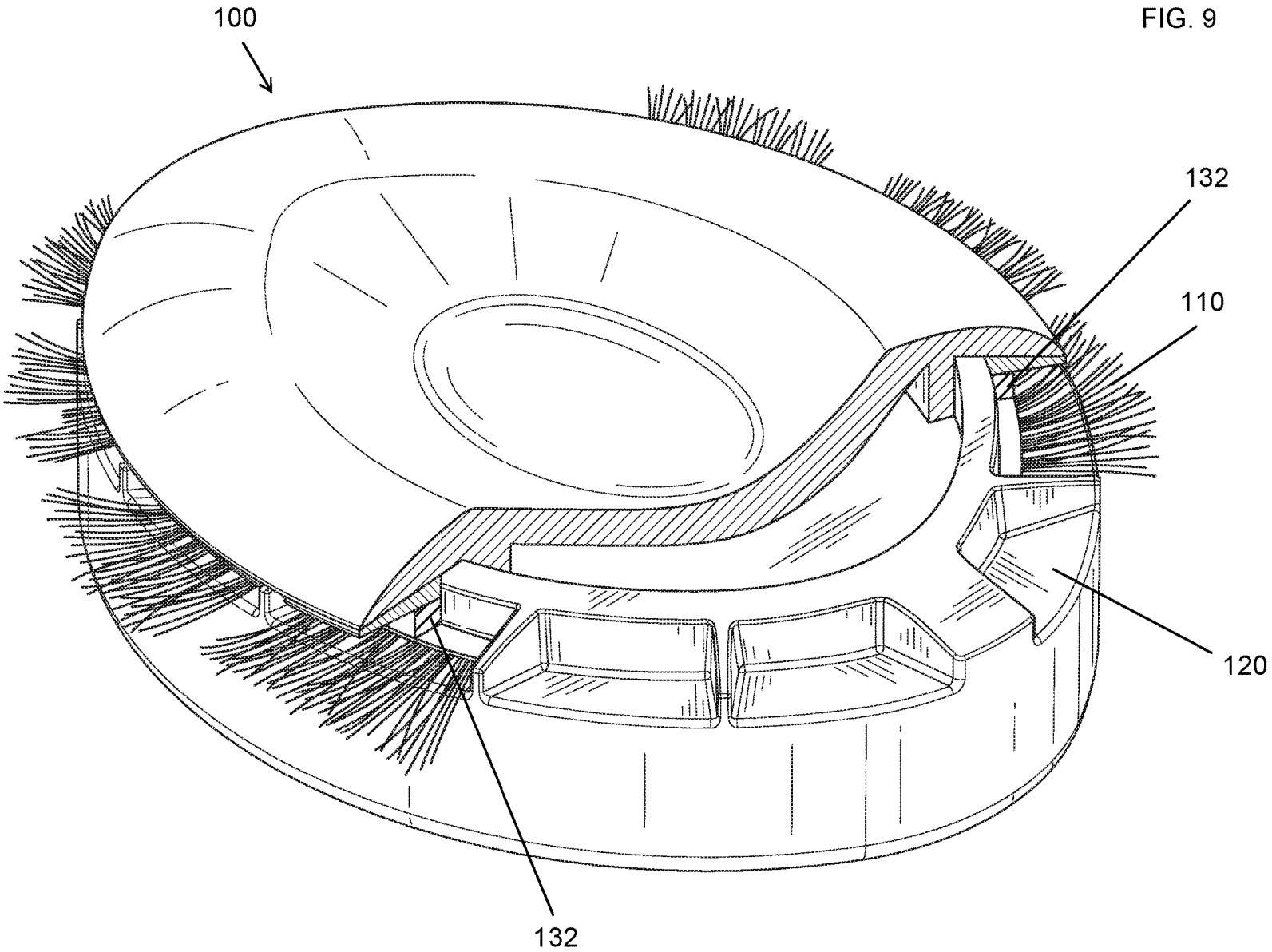
FIG. 9 shows an embodiment of a gasket and an inclined floor according to this disclosure.
Figure 10:
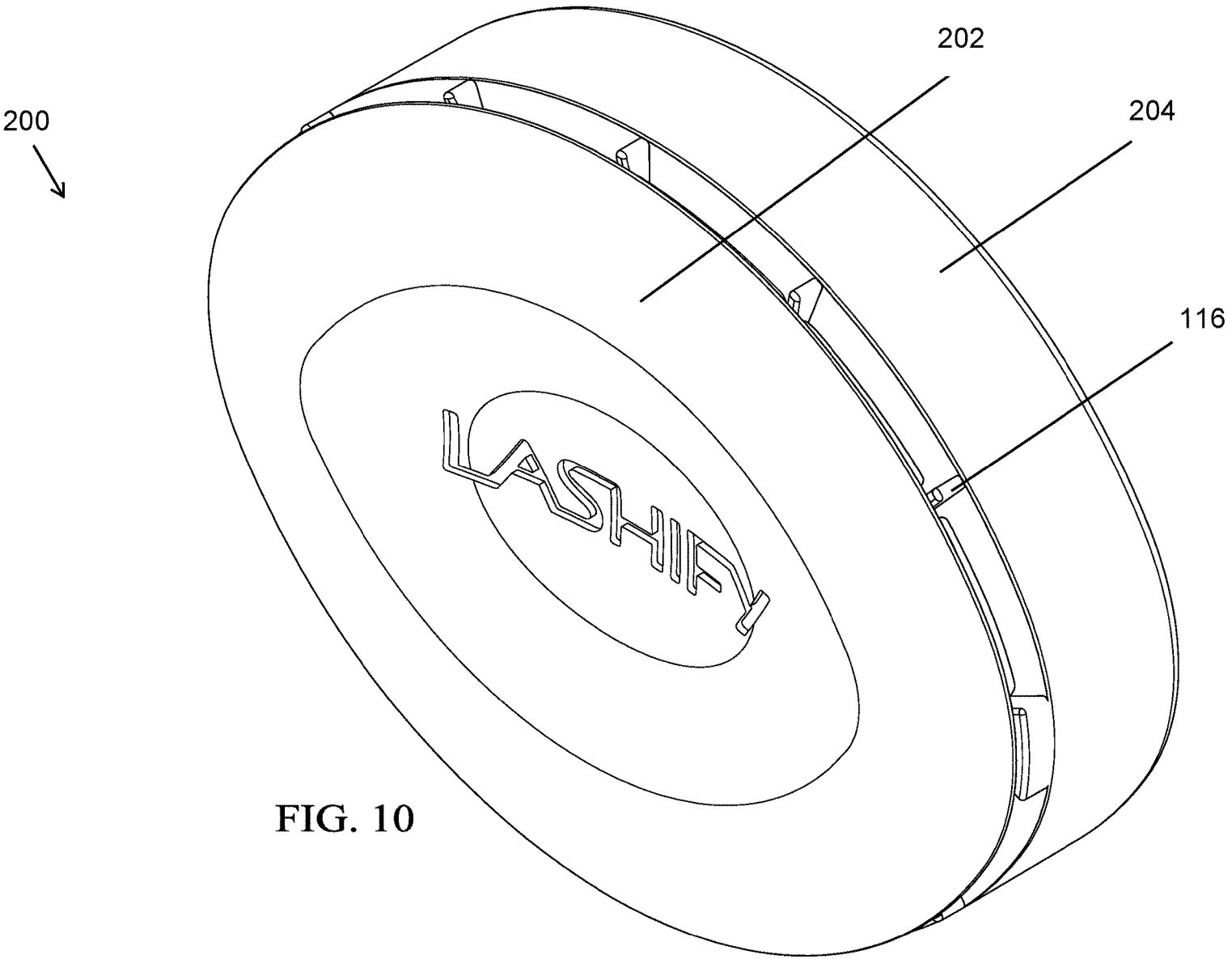
FIGS. 10-33 show an embodiment of a case where a gasket is separate and distinct from a lid and a body according to this disclosure.
Figure 11:
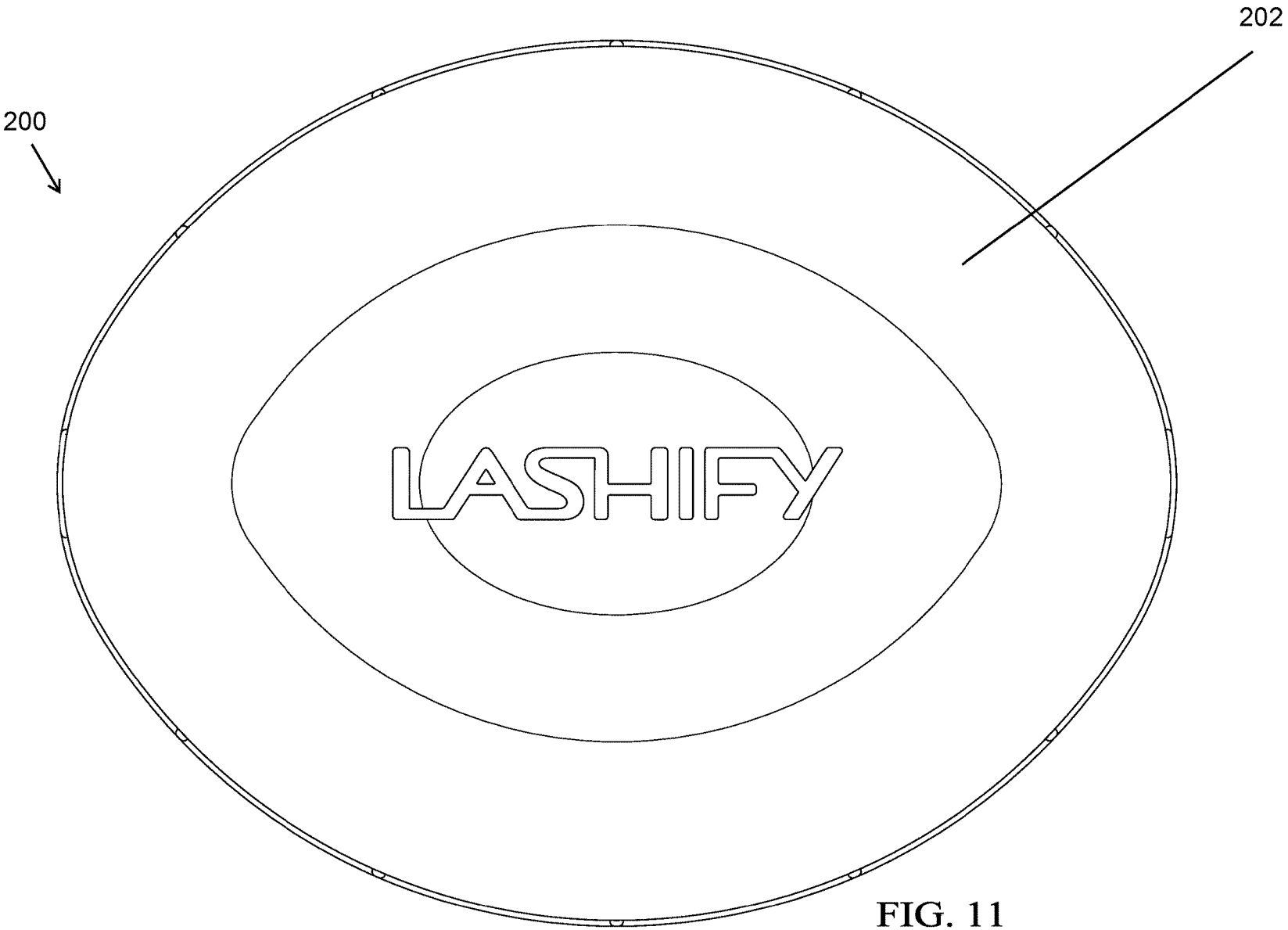
Figure 12:
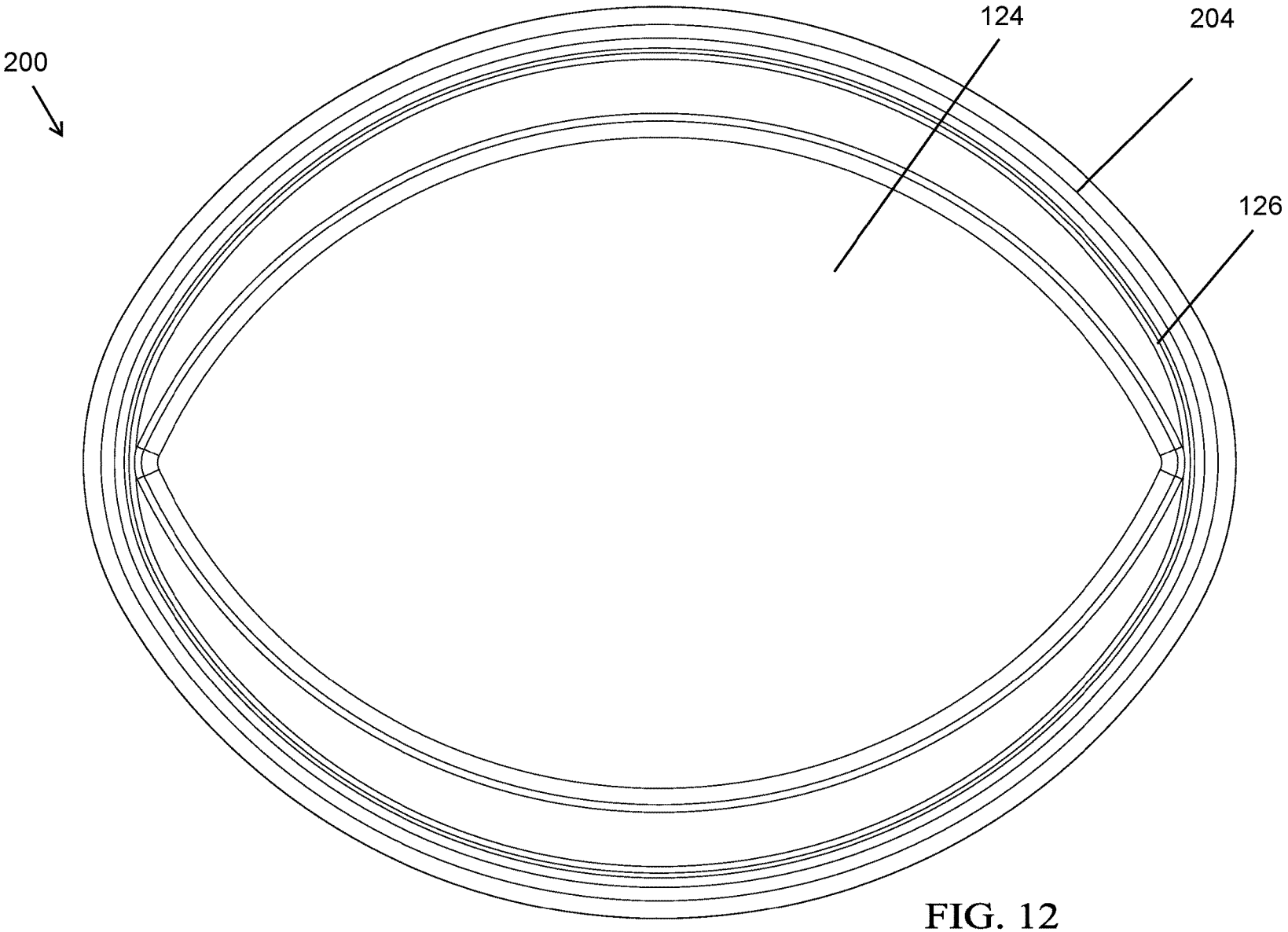
Figure 14:
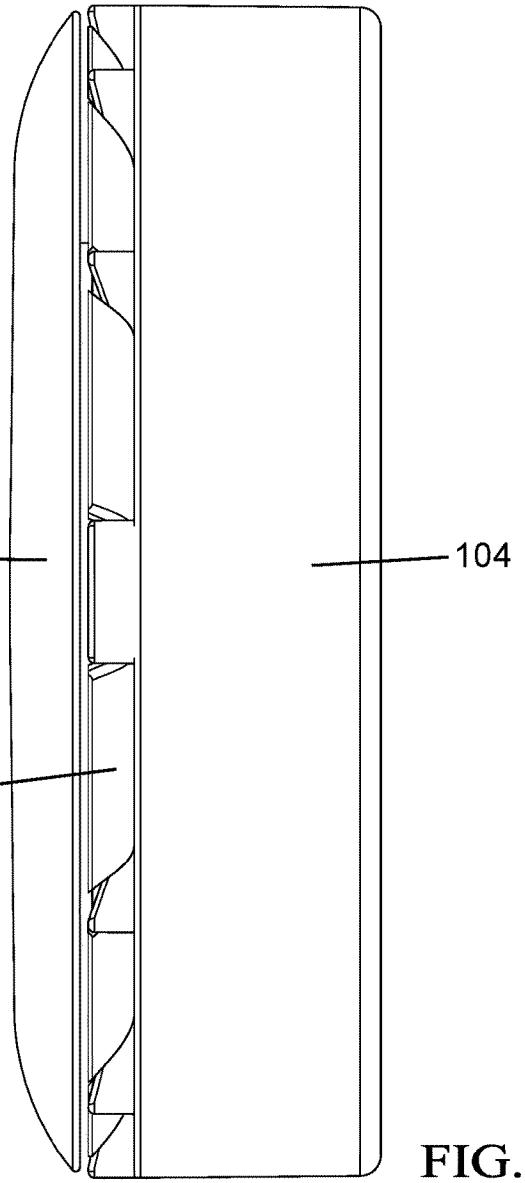
Figure 13:
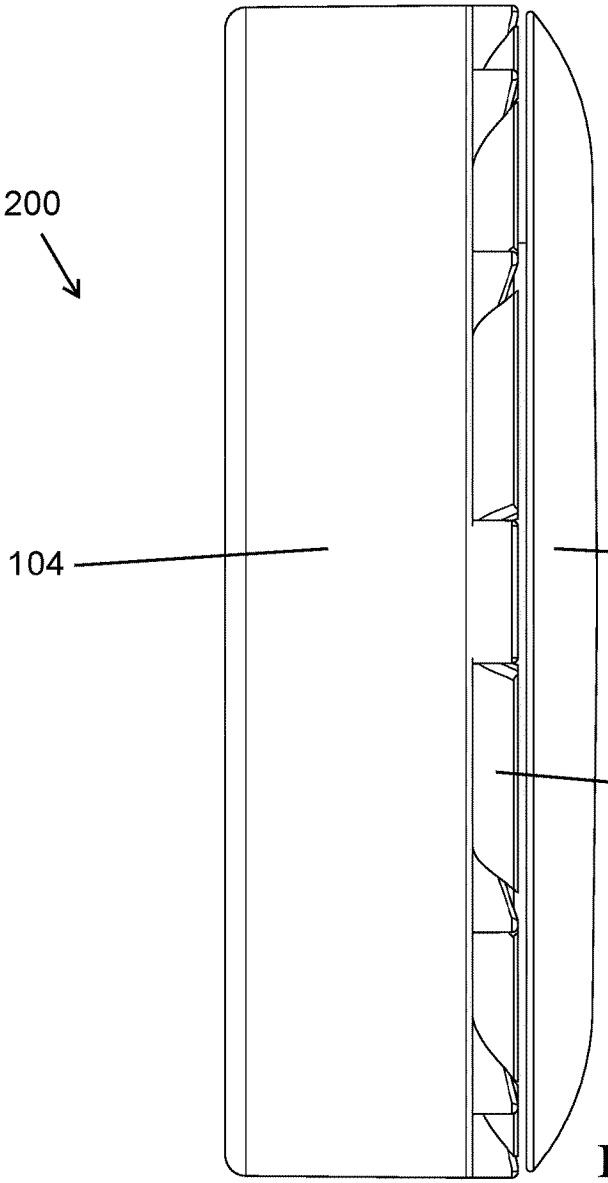
Figure 15:
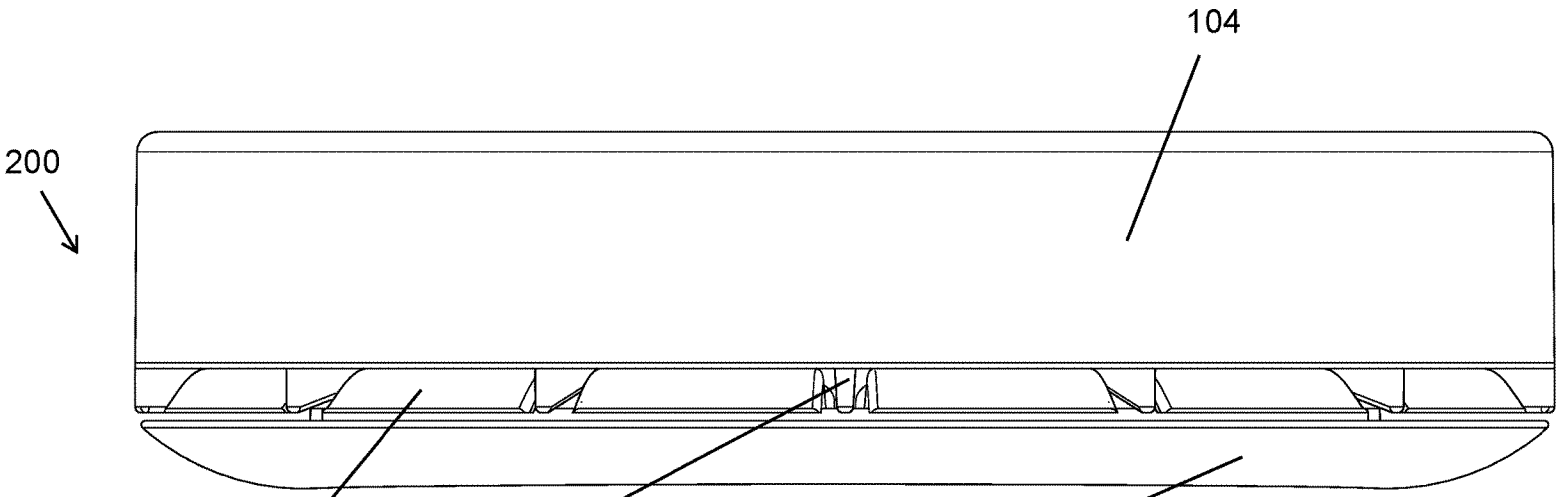
Figure 16:
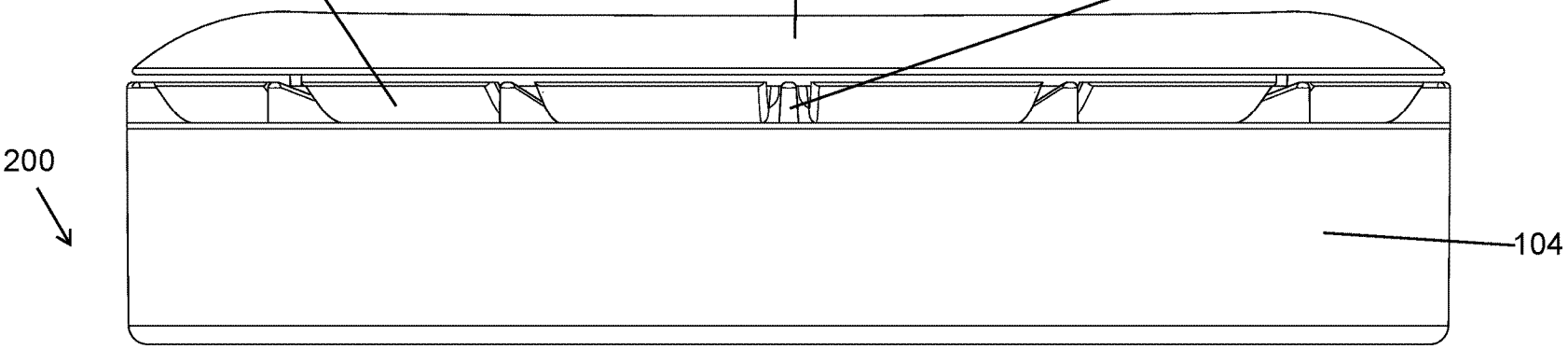
Figure 17:
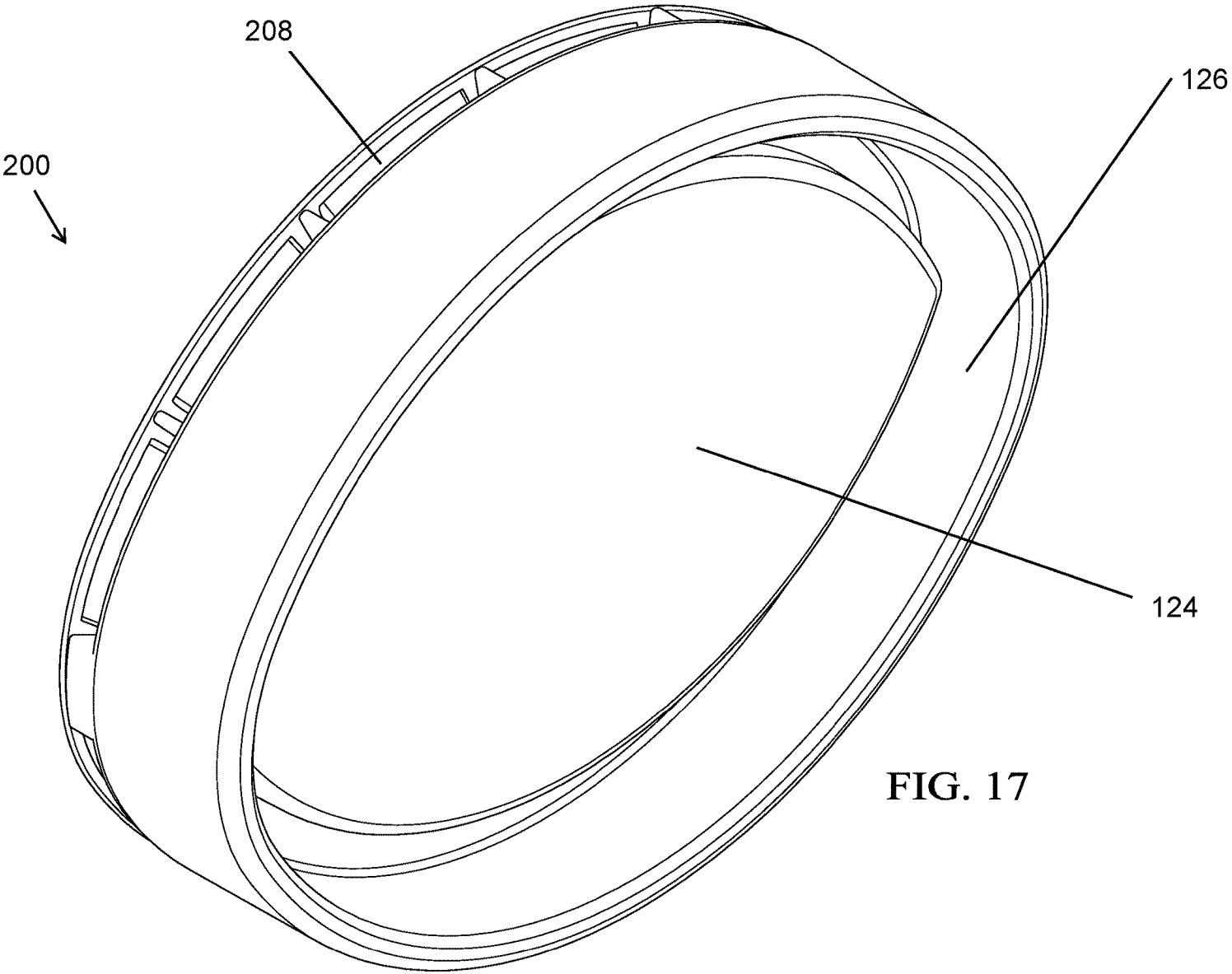
Figure 18:
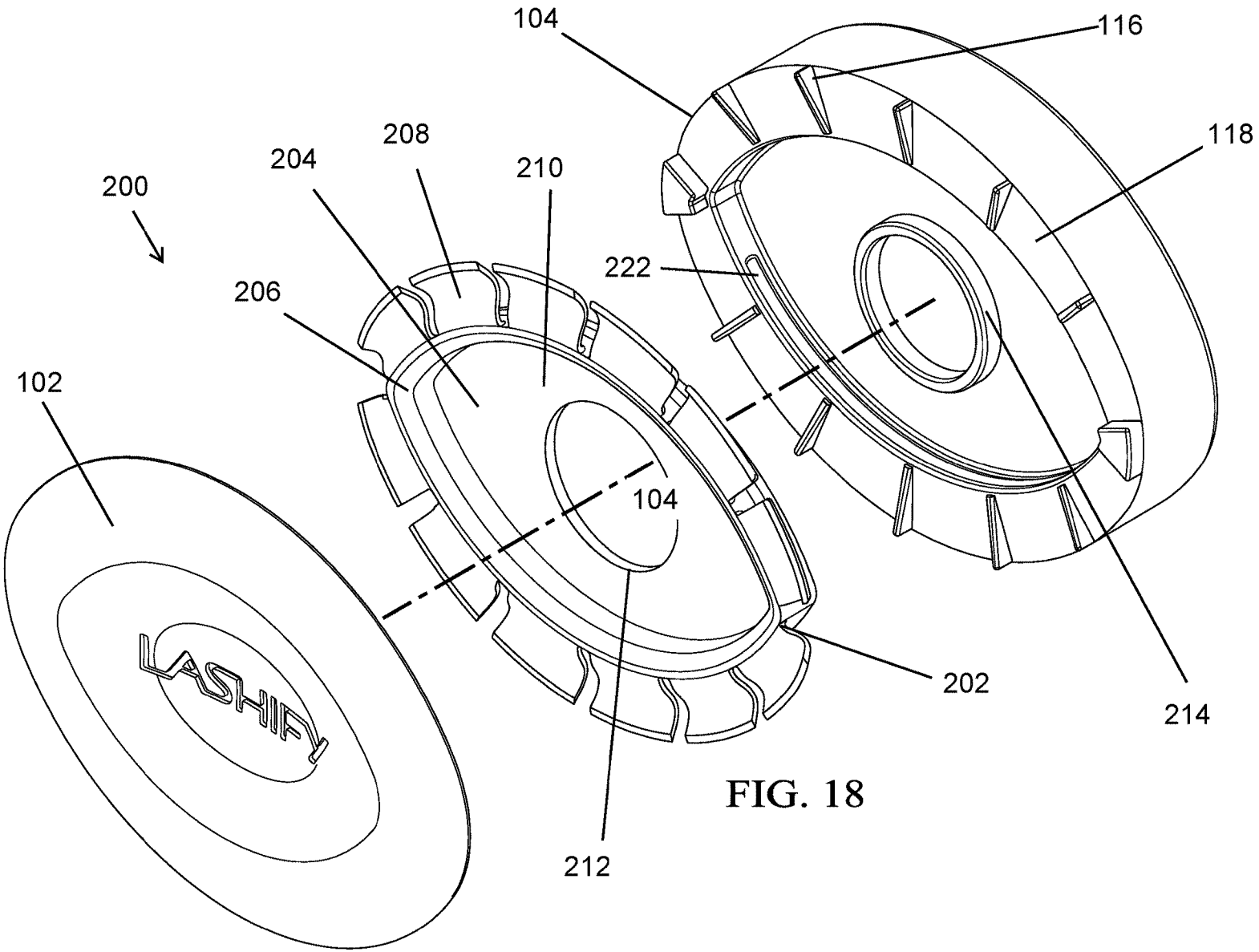
Figure 19:
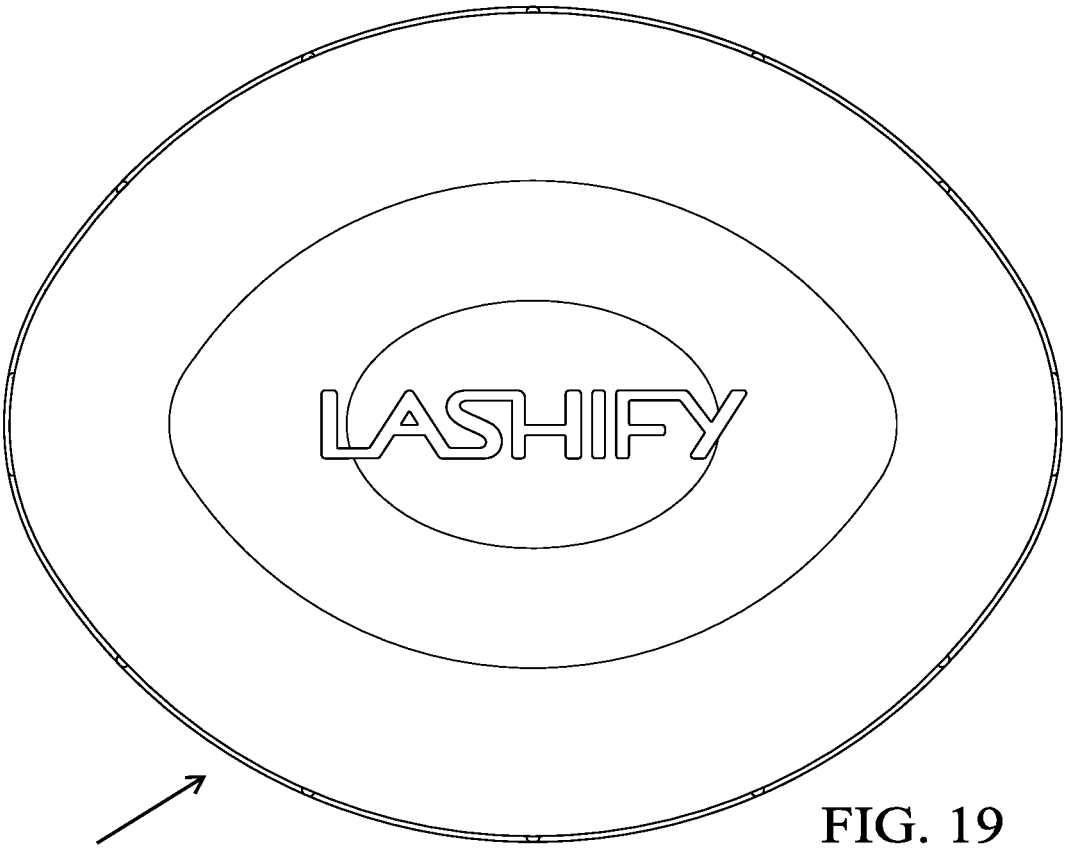
Figure 20:
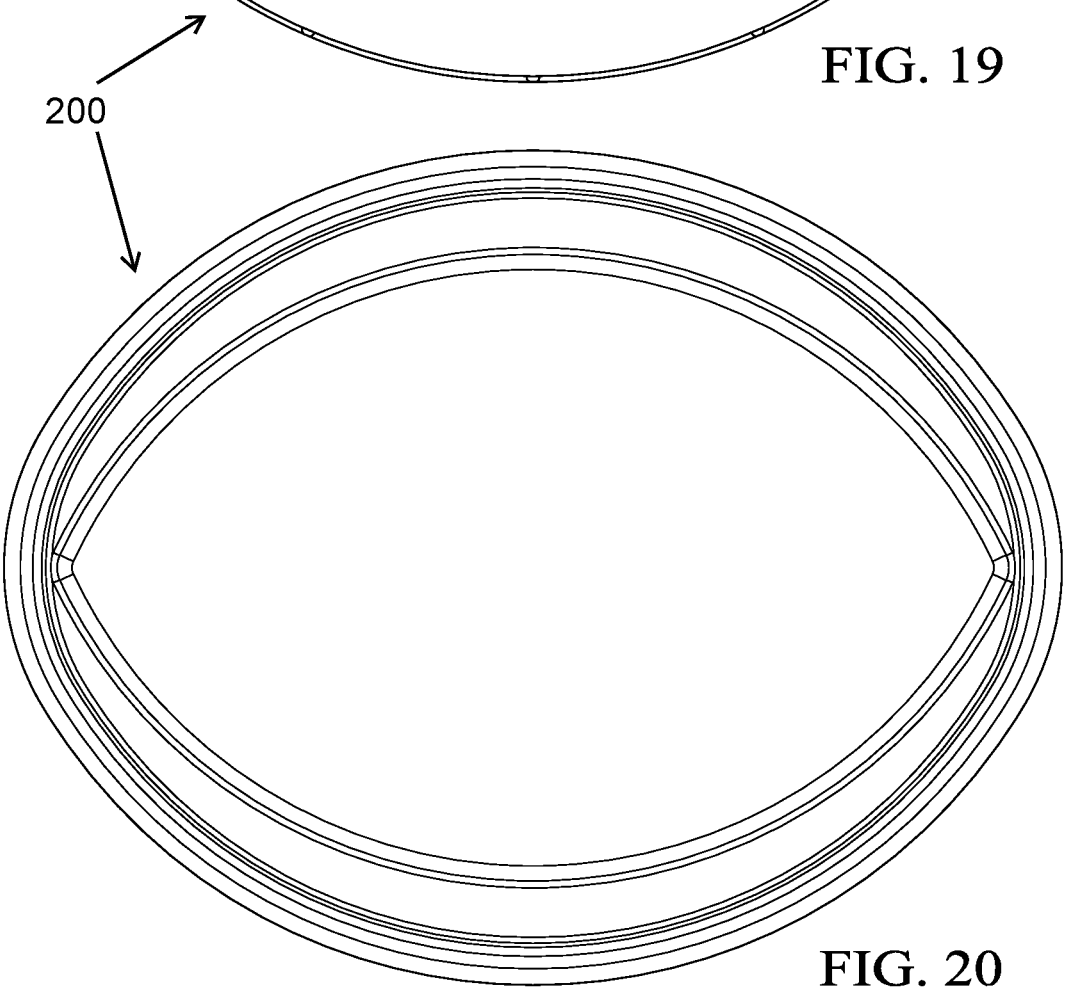
Figure 21:
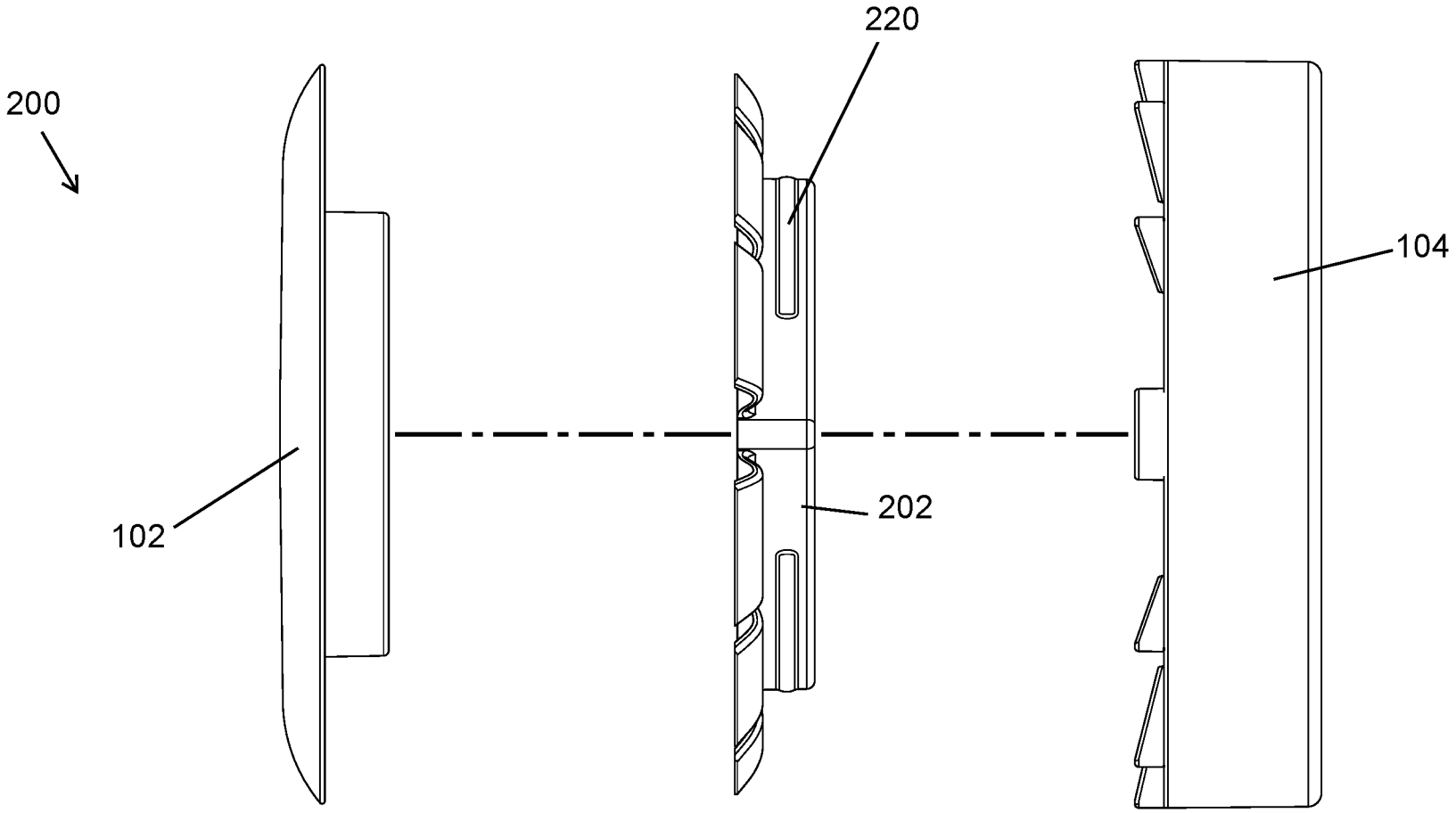
Figure 22:
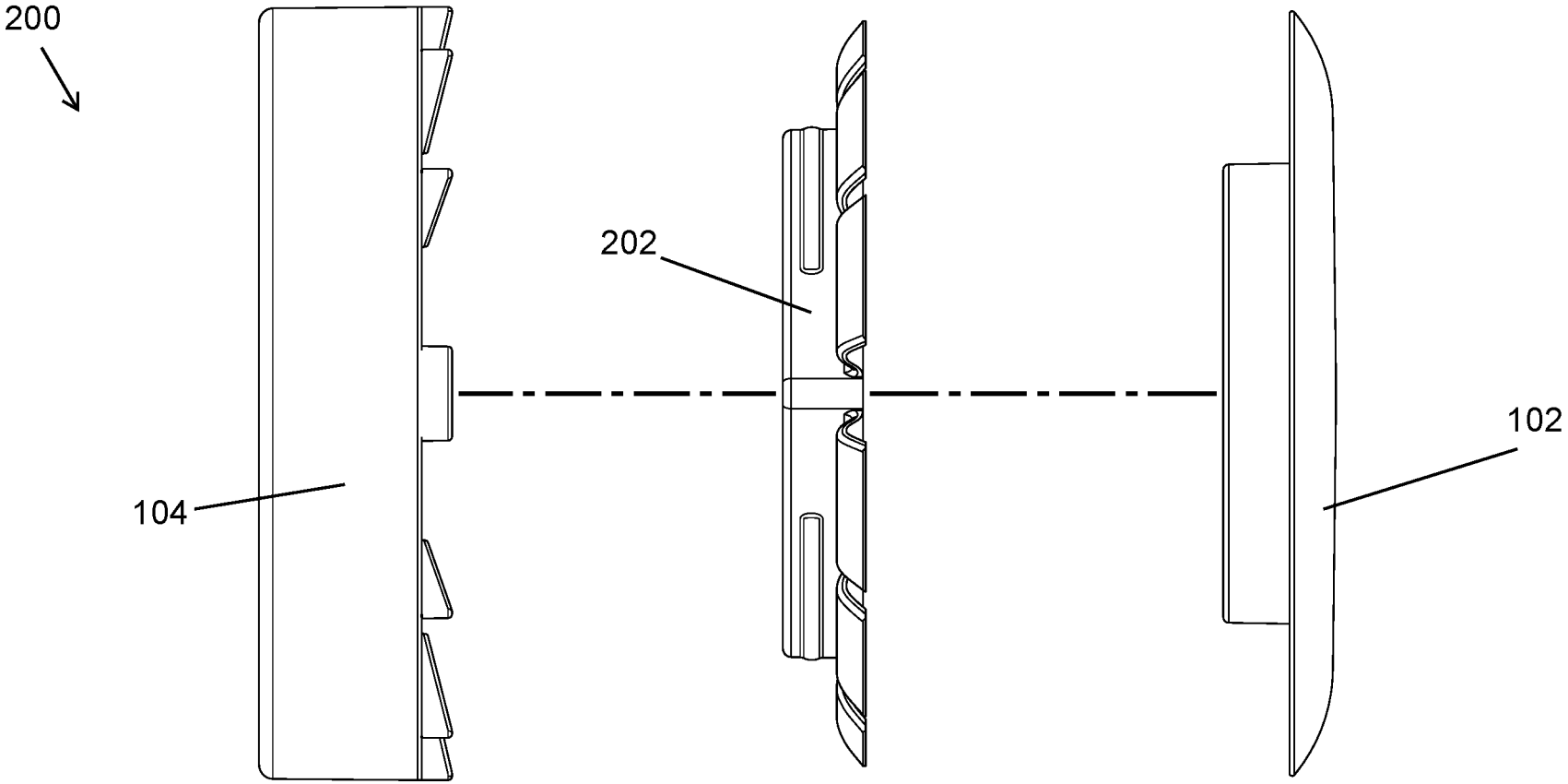
Figure 23:
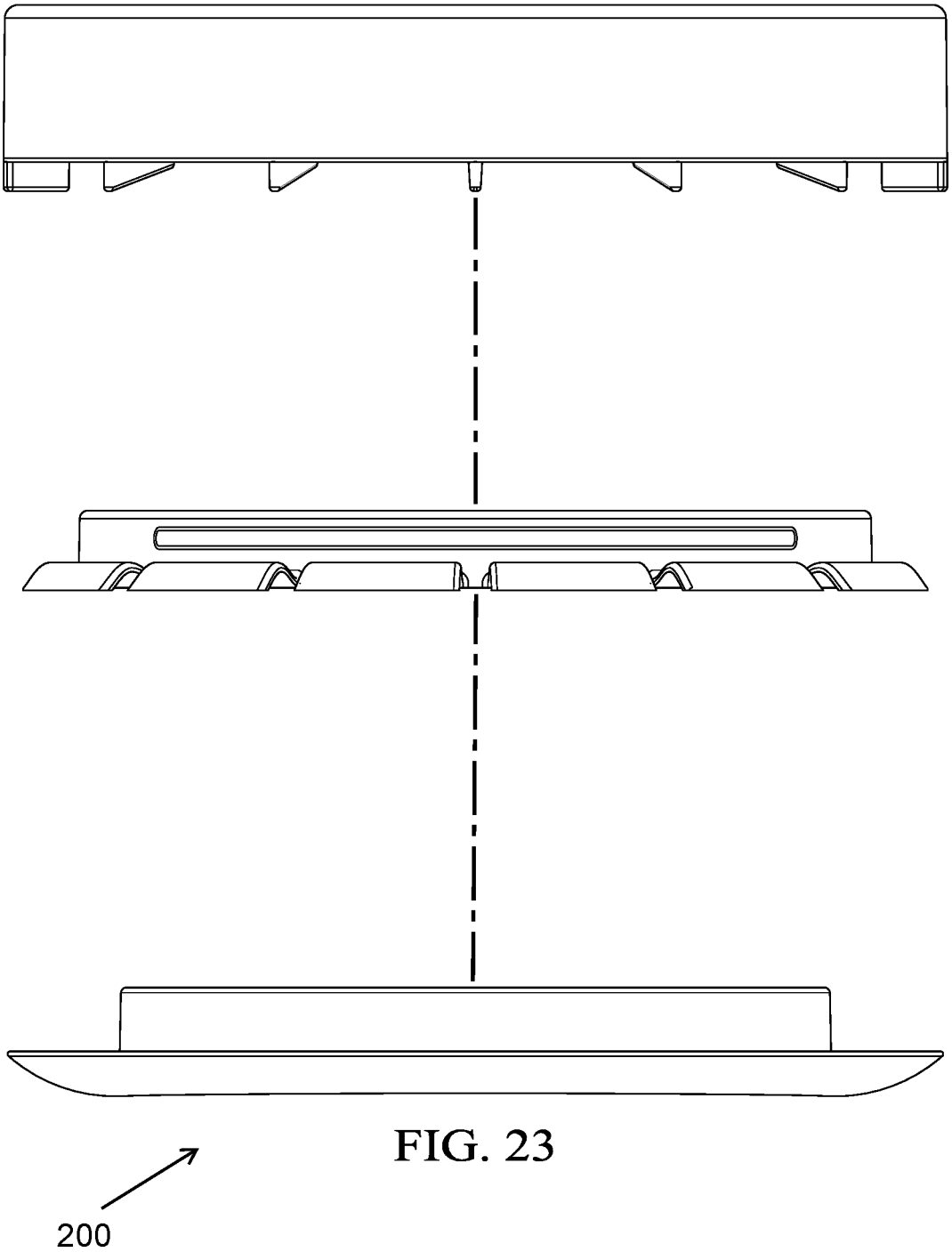
Figure 24:
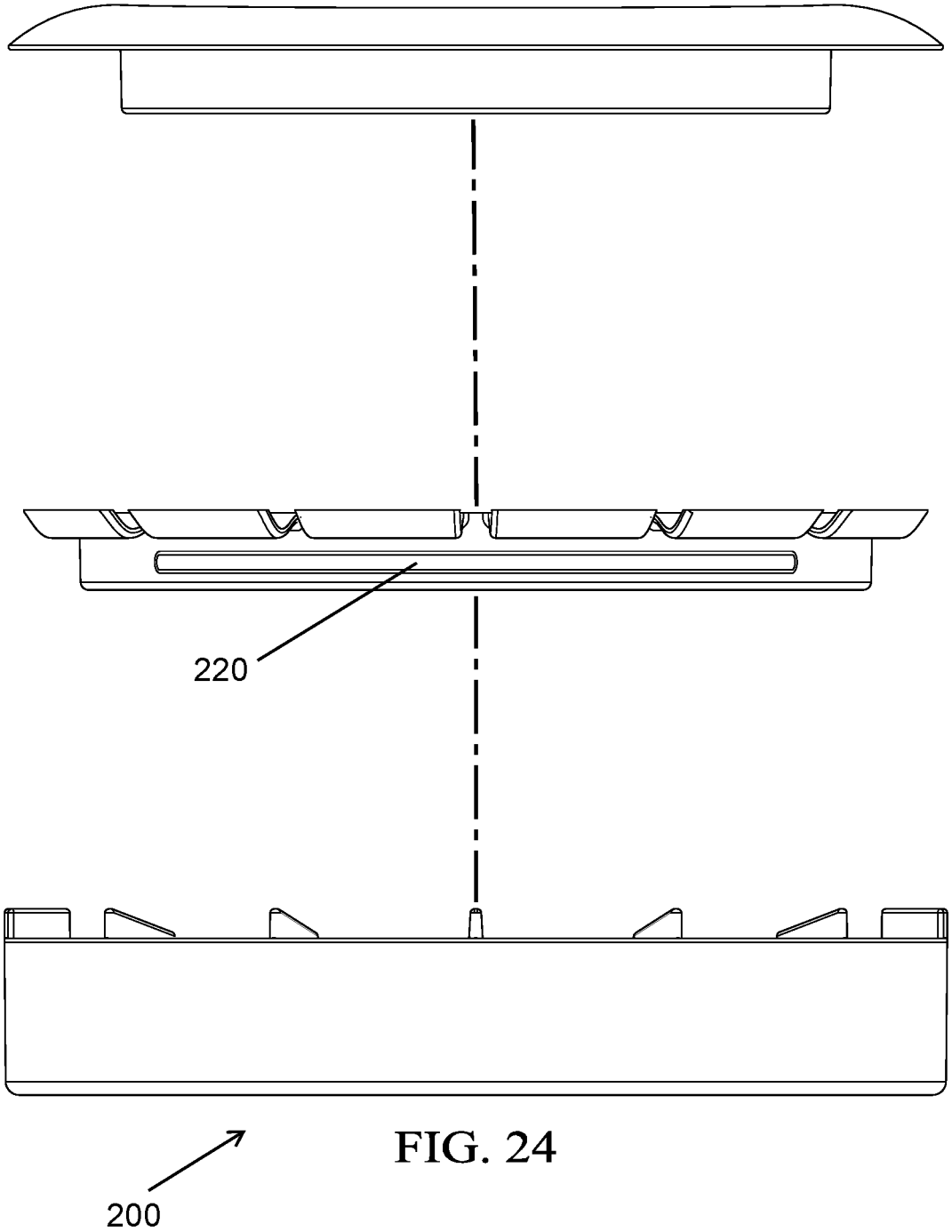
Figure 25:
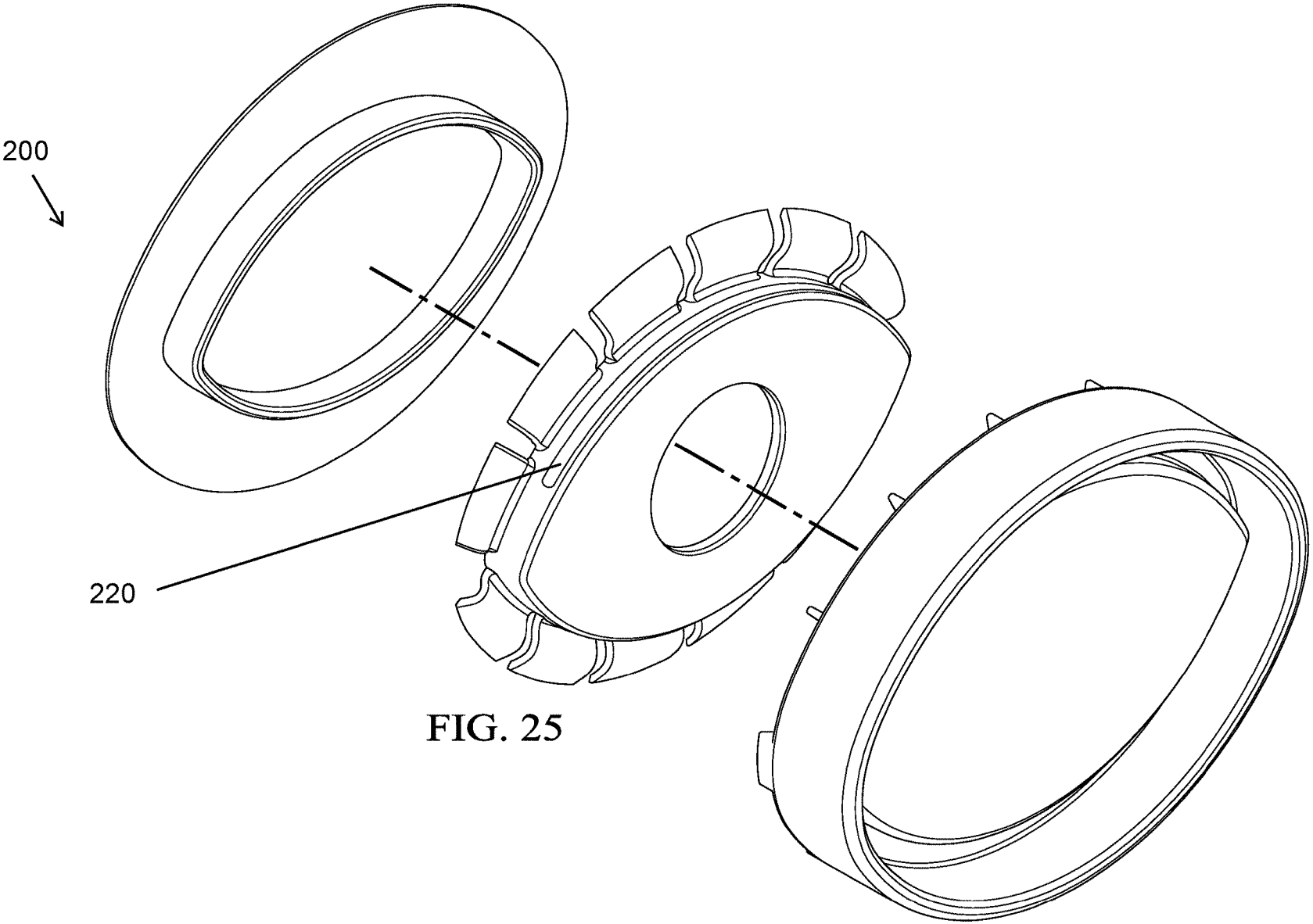
Figure 26:
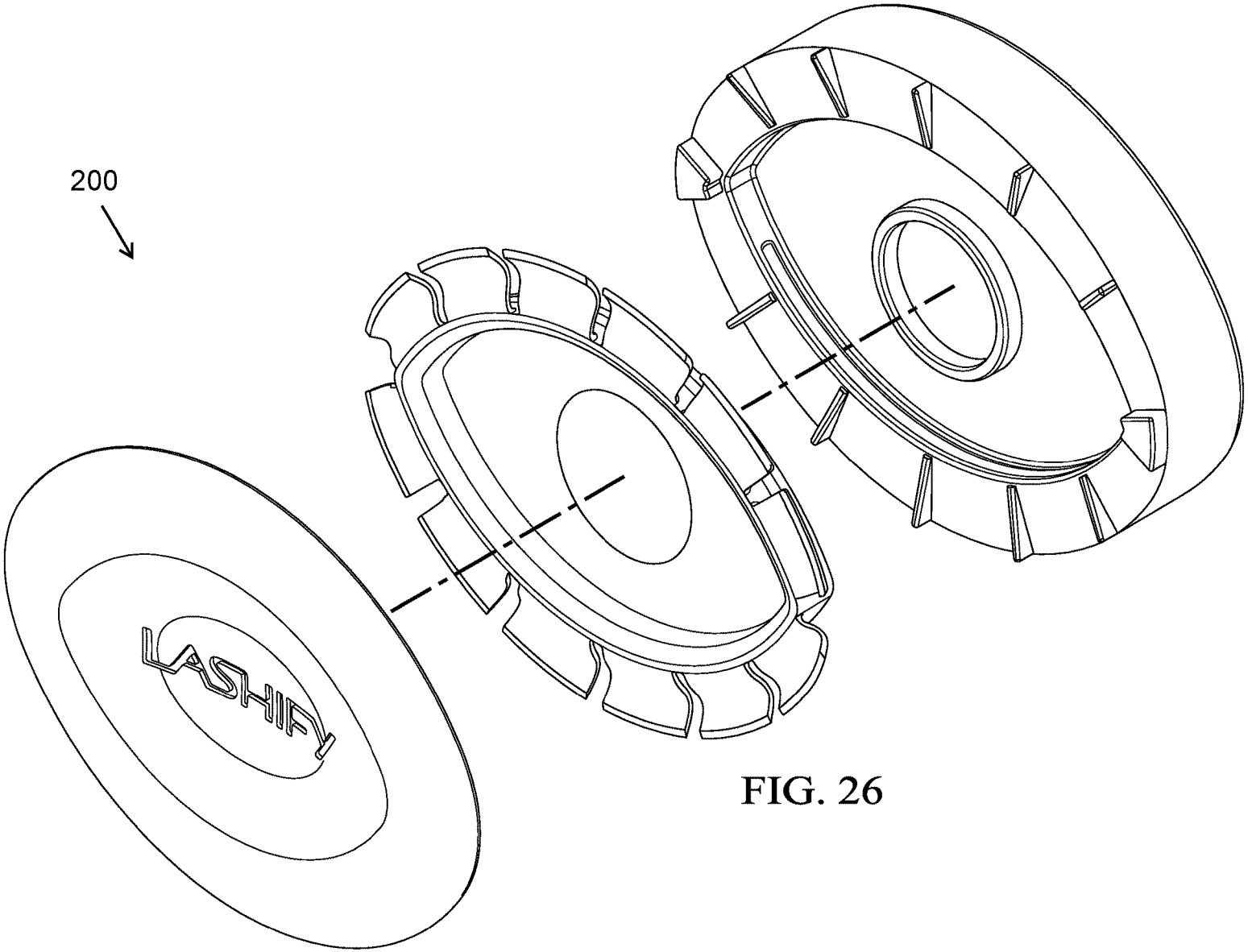
Figure 27:
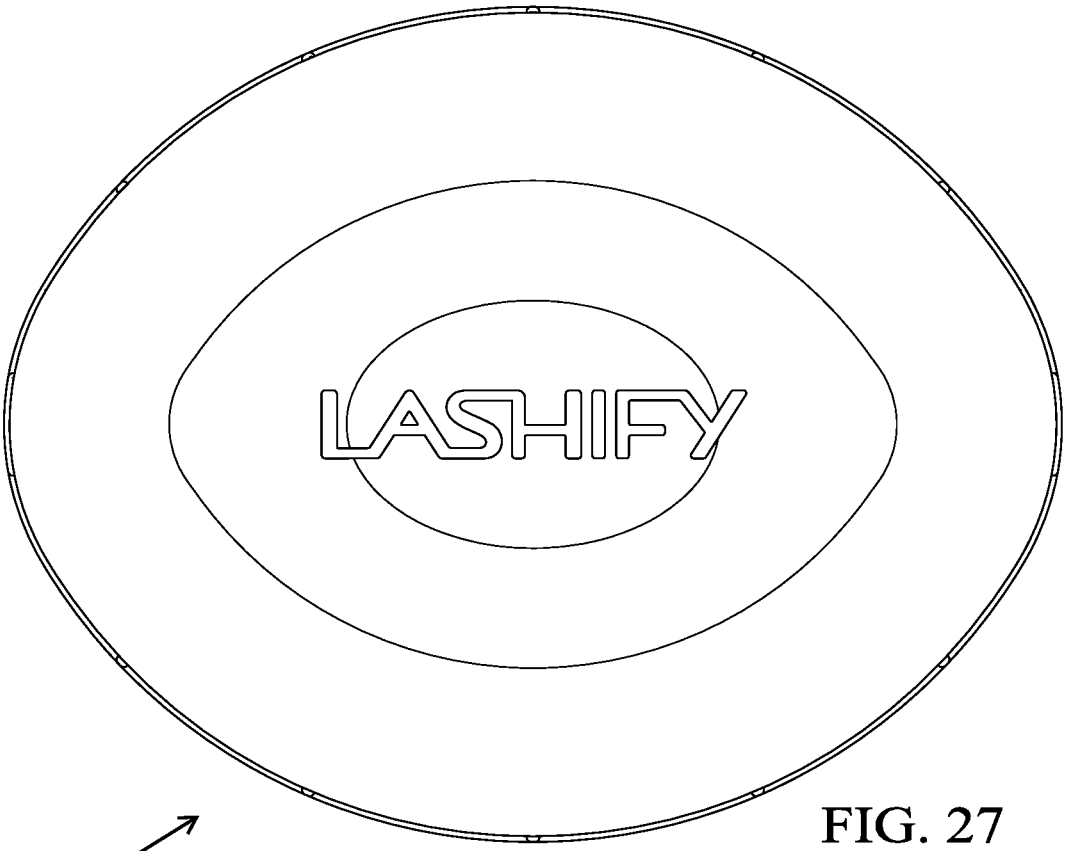
Figure 28:
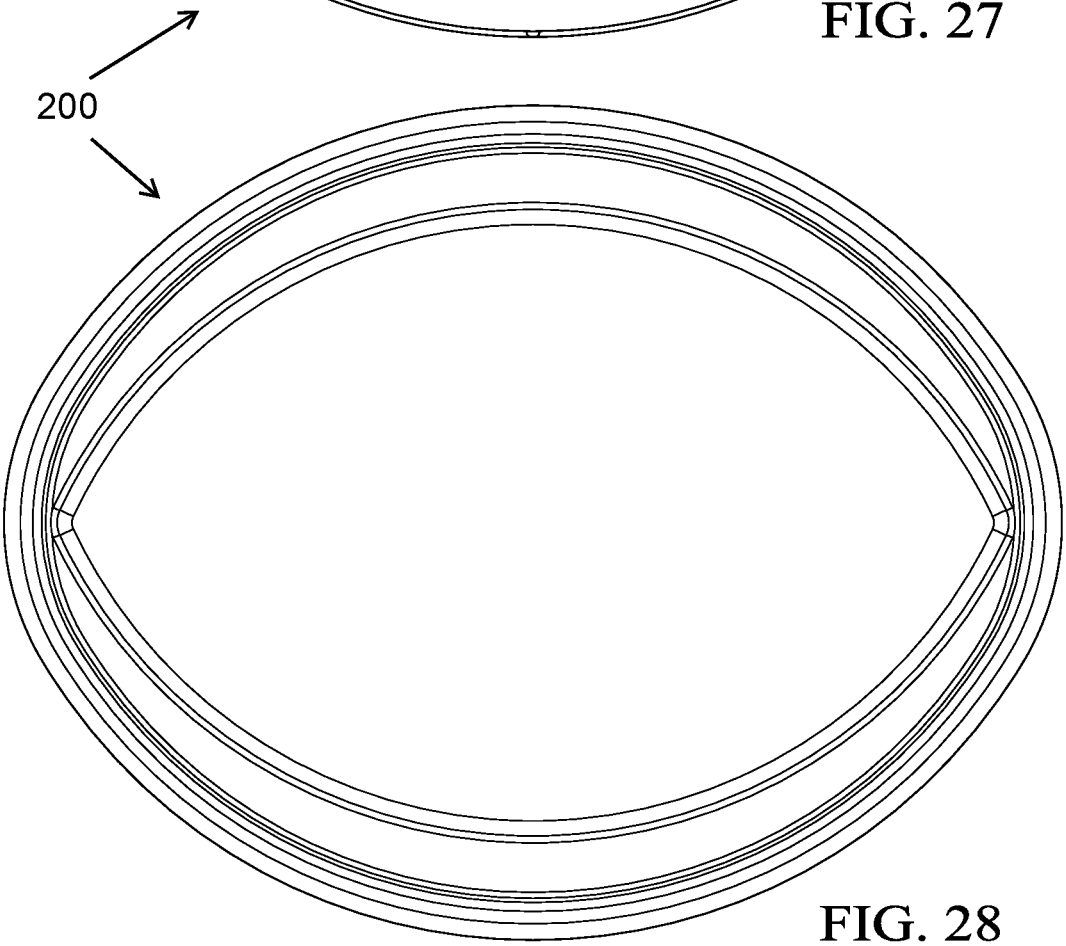
Figure 29:
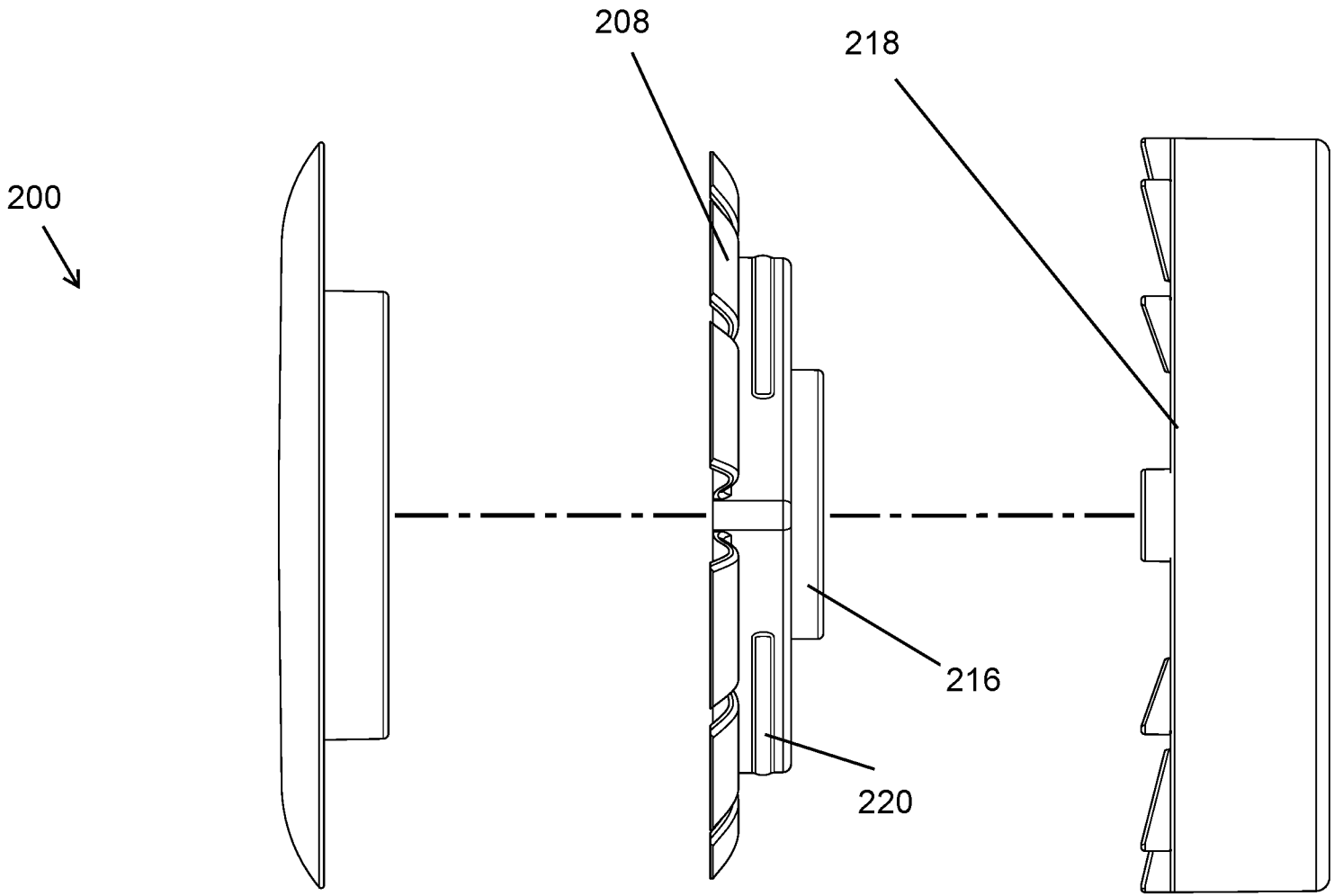
Figure 30:
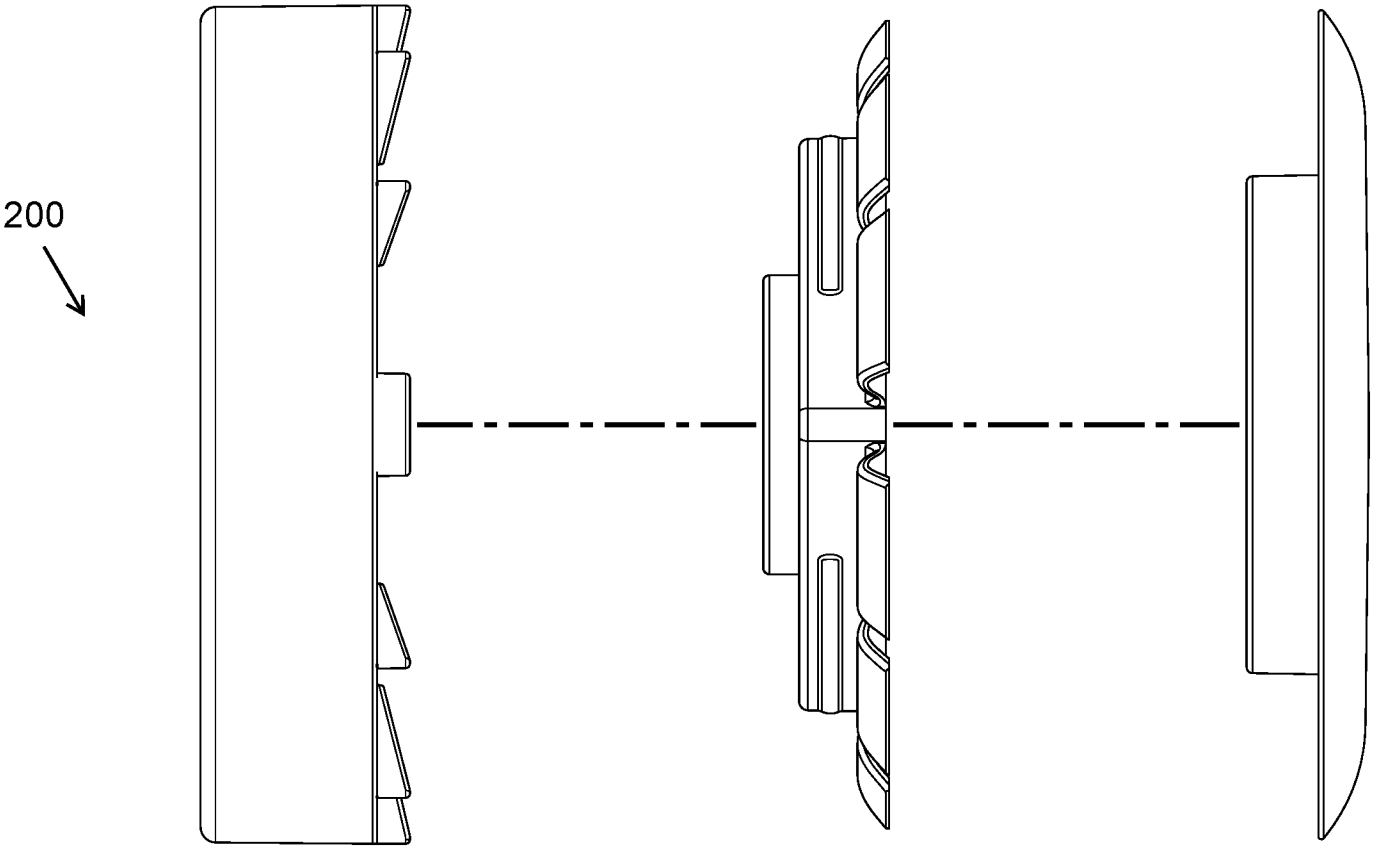
Figure 31:
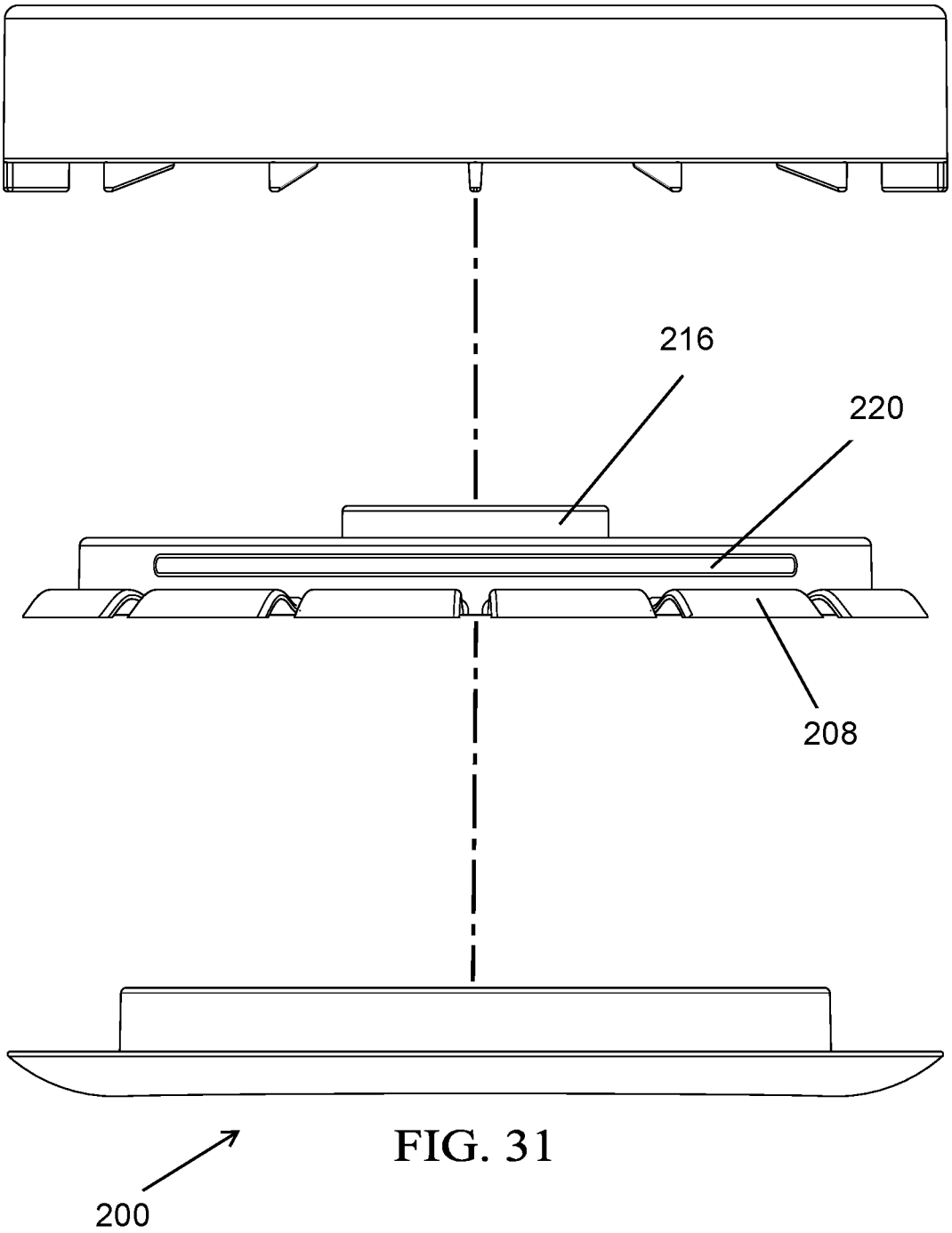
Figure 32:
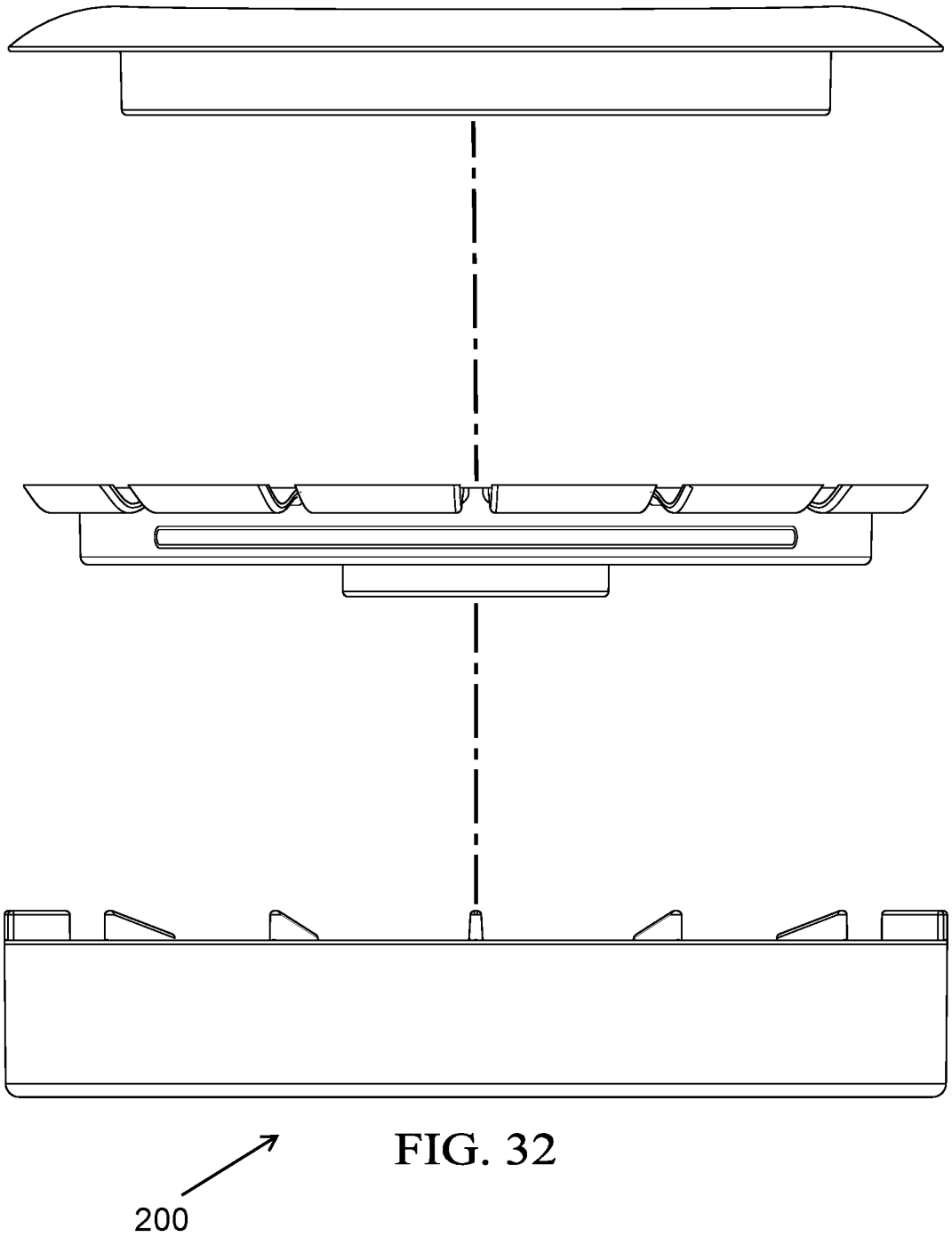
Figure 33:
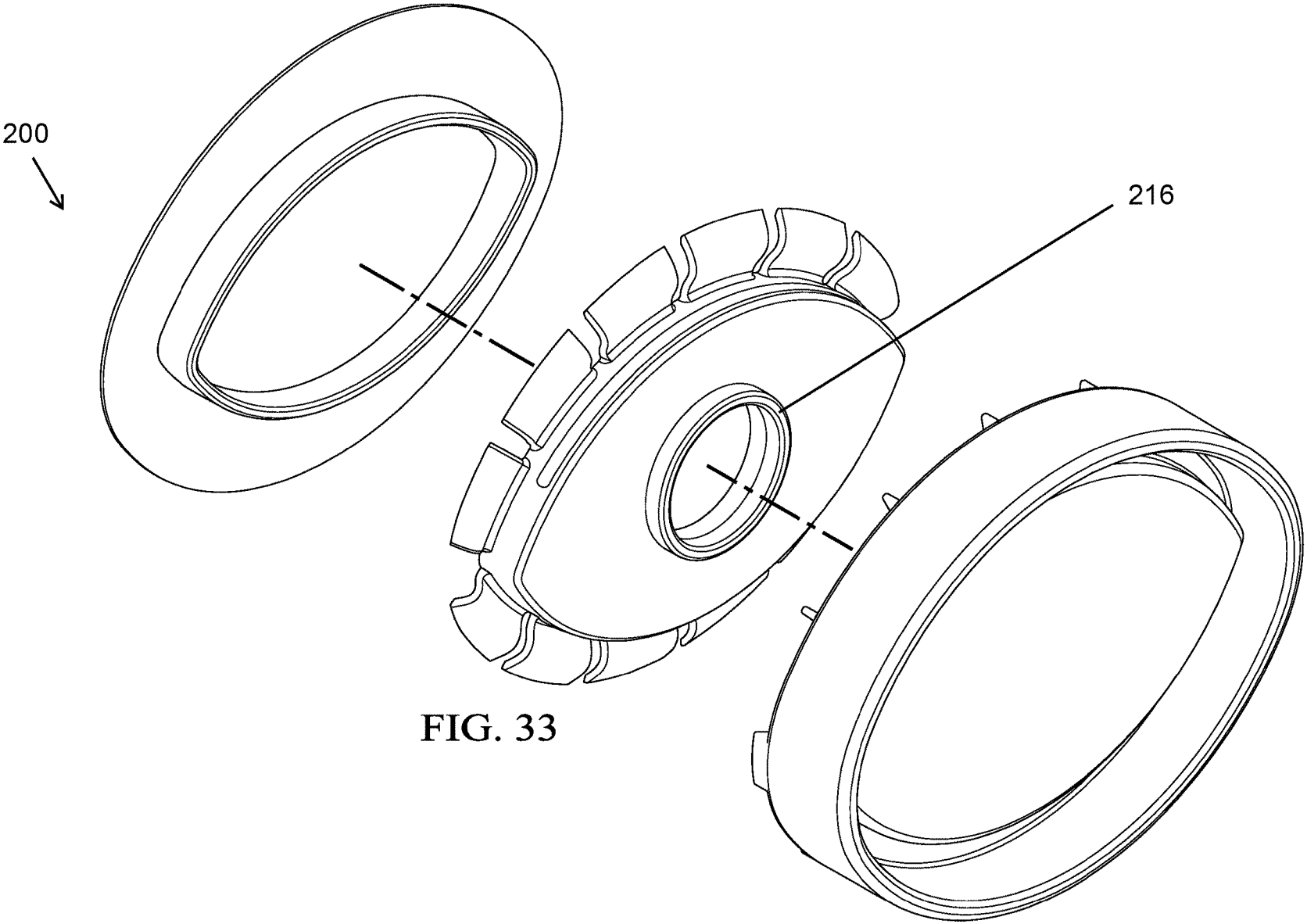

FIGS. 1-6 show an embodiment of a case for hosting a plurality of artificial lash extensions according to this disclosure. FIG. 7 shows an embodiment of a lid hosting a visual indicia thereon according to this disclosure. FIG. 8 shows an embodiment of a lid and a body according to this disclosure. FIG. 9 shows an embodiment of a gasket and an inclined floor according to this disclosure. In particular, a case 100 has a lid 102 and a body, housing, or pedestal 104.

The lid 102 includes plastic, but can include other materials, such as metal, rubber, wood, foam, or others. The lid 102 is opaque, but can be transparent or translucent. The lid 102 is eye-shaped, although other shapes are possible, whether open-shape or closed-shape, whether symmetrical or asymmetrical, such as a circle, square, rectangle, pentagon, octagon, triangle, trapezoid, or any other polygonal shape. The lid 102 sits or rests on the body, which can be securely, such as via mating, fastening, interlocking, adhering, magnetizing, hook-and-looping, or others.

The lid 102 has an outer side 106 that can host various visual indicia 108 thereon, such as a brand indicia, an orientation indicia, a type or sub-type of artificial lash extension or others. The visual indicia 108 can include alphanumerics and images, whether adhered, stamped, engraved, embossed, holographic, barcode, QR code, augmented reality marker, or others. For example, a kit, a package, a container, an envelope, a box, an intermodal container, or a system can include a plurality of artificial lash extension types 110 each of which can be solely hosted in the case 100 and the lid 102 of the case 100 can host a visual indicia 108 of type of artificial lash extension 110 or others (e.g., B.12 or A.14 or C.10). The outer side 106 hosts an inward central dimple 112, although a flat surface or a central or offset bump or offset inward dimple is possible. The inward central dimple 112 can host the visual indicia 108.

The body 104 includes plastic, but can include other materials, such as metal, rubber, wood, foam, or others. The body 104 is translucent, but can be opaque or transparent. The body 104 is configured to support the lid 102, which can be securely, such as via mating, fastening, interlocking, adhering, magnetizing, hook-and-looping, or others. The body 104 is internally structured to accommodate for the central inward dimple 112 of the lid 102.

The body 104 has an outer sidewall 114 with an outer side that is longitudinally eye-shaped, although other shapes are possible, whether open-shape or closed-shape, whether symmetrical or asymmetrical, such as a circle, square, rectangle, pentagon, octagon, triangle, trapezoid, or any other polygonal shape. The outer sidewall 114 hosts a plurality of vertical partitions 116 that define a plurality of storage slots 118 (e.g., ledges) structured for storing the artificial lash extensions 110, such as in a one-to-one correspondence, although other types of correspondences are possible, such as one storage slot 118 for at least two artificial lash extensions 110 stacked one on top of another or positioned side-by-side in any orientation. At least one of the vertical partitions 116 can have a top surface that is level or inclined, whether inwardly or outwardly. For example, at least one of the vertical partitions 116 can be square, rectangular, oval, arcuate, triangular, pyramidal, dome, wedged, or another shape.

Figure 1:
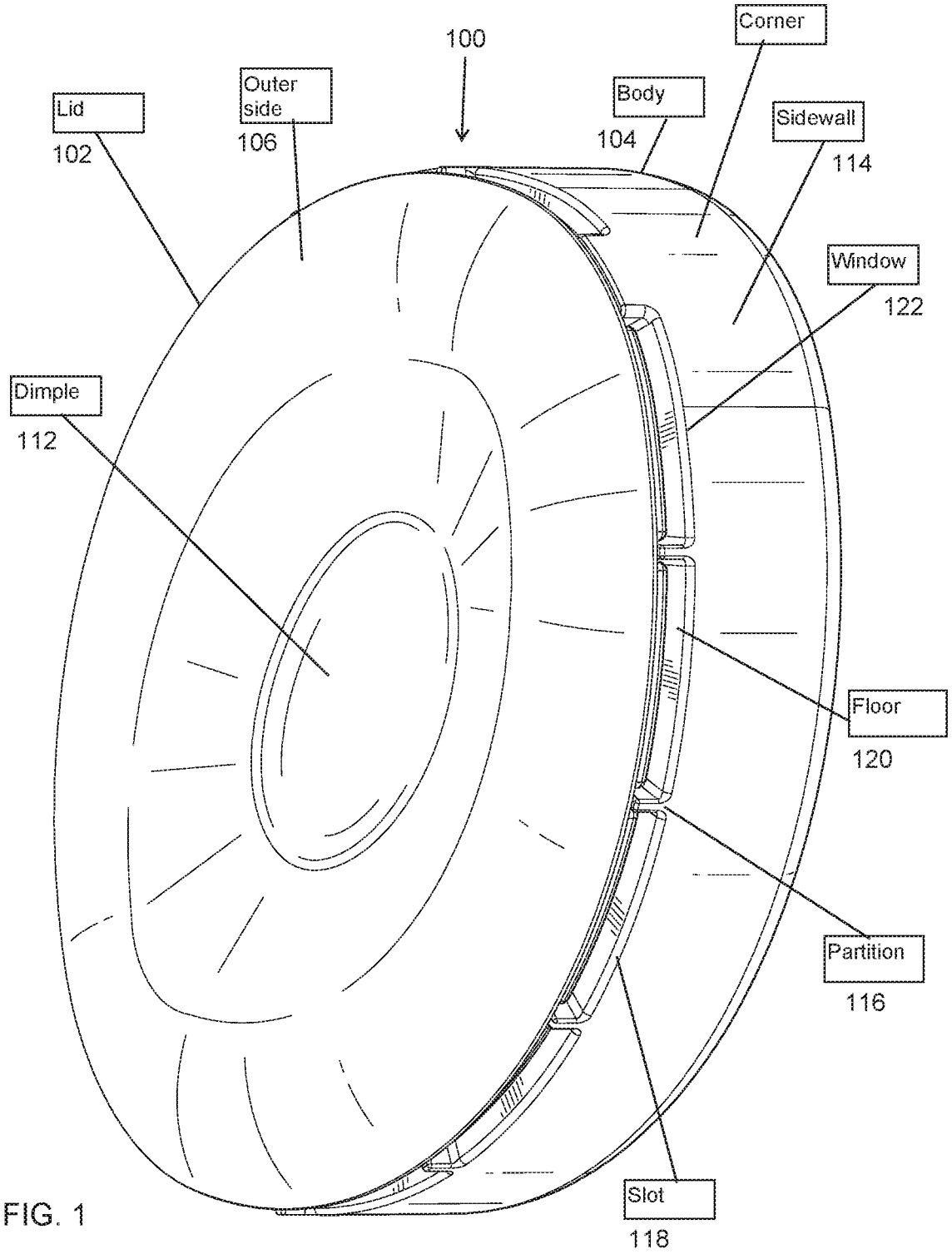
FIGS. 1-6 show an embodiment of a case for hosting a plurality of artificial lash extensions according to this disclosure.
Figure 2:
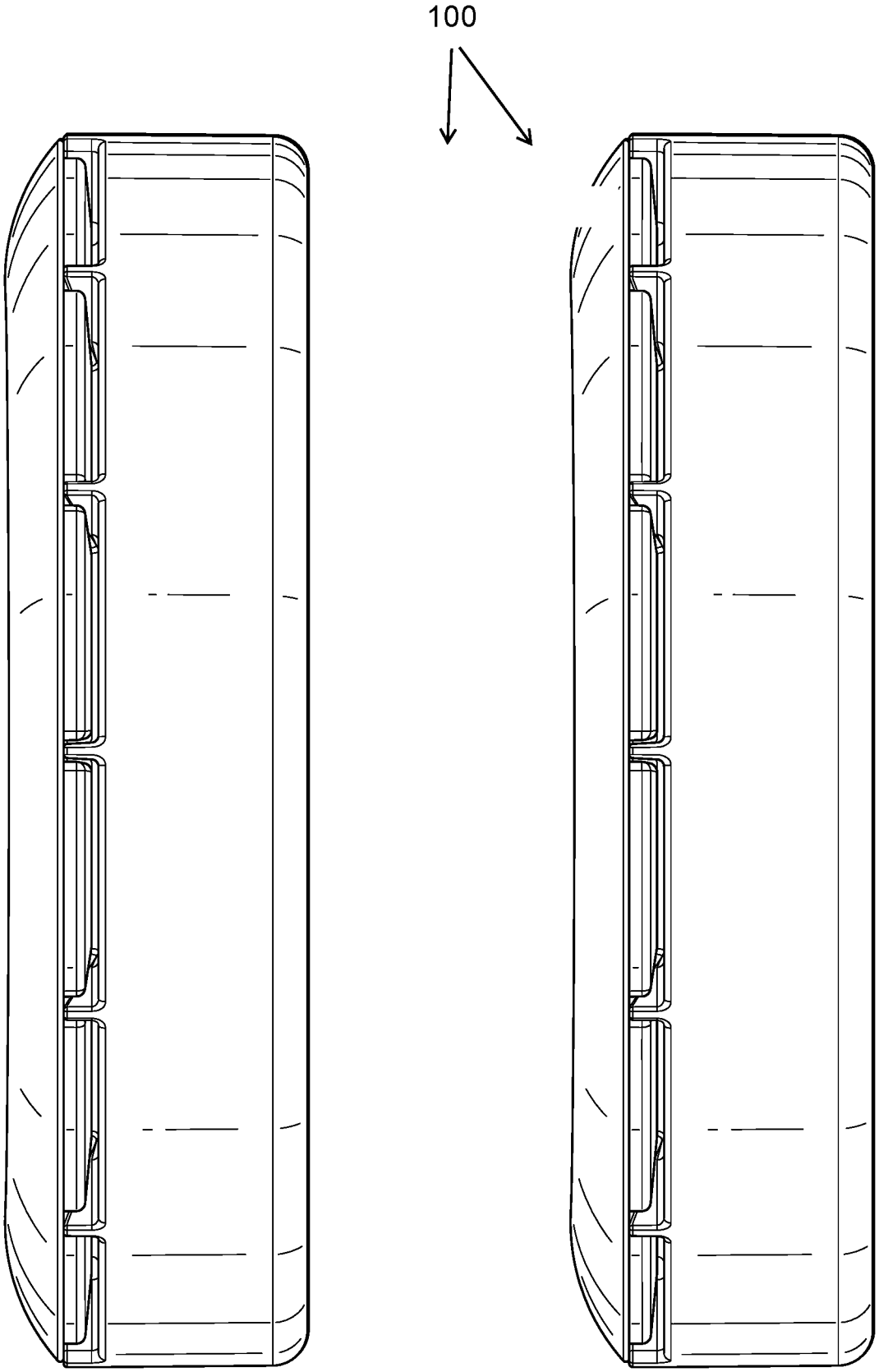
Figure 3:
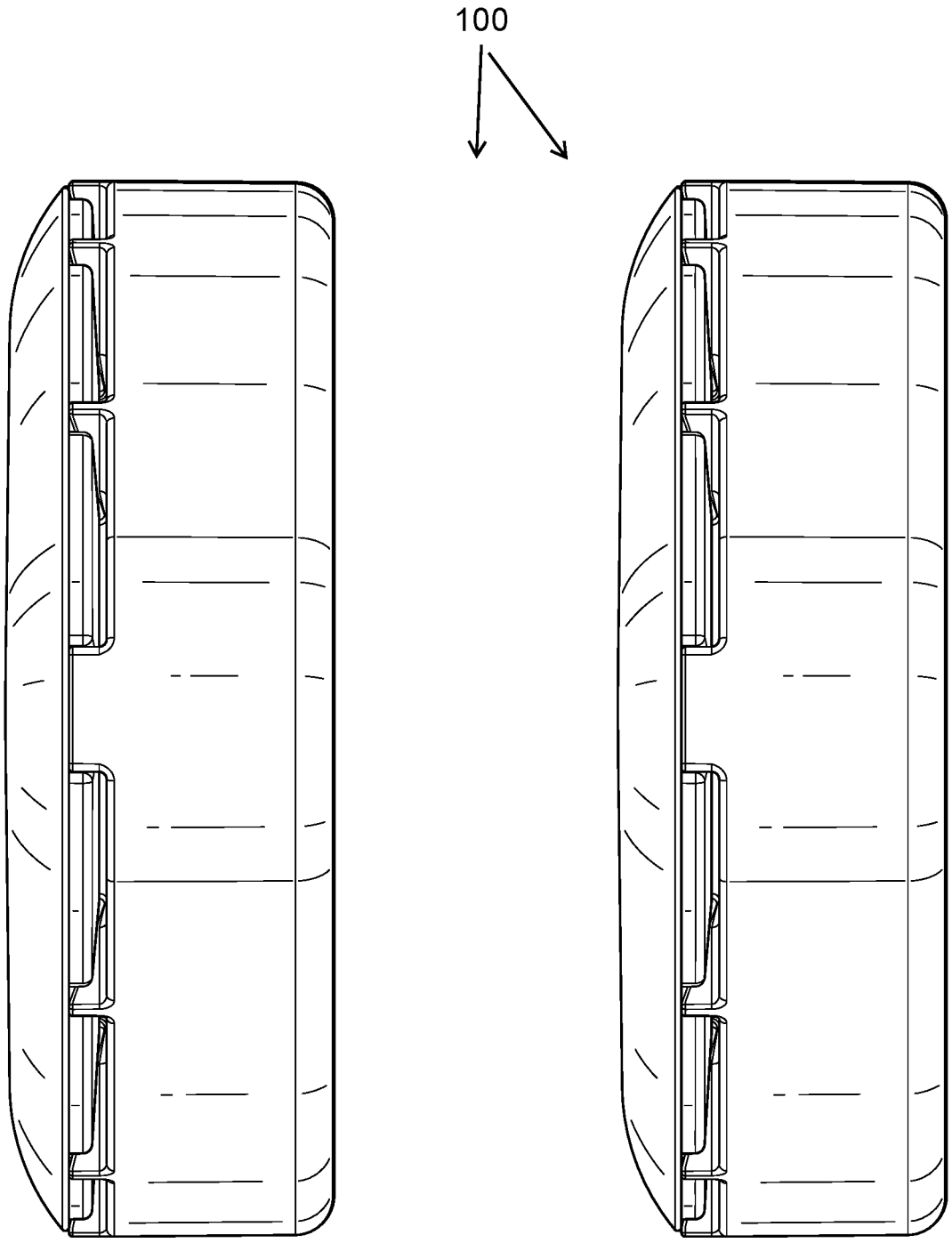
Figure 4:
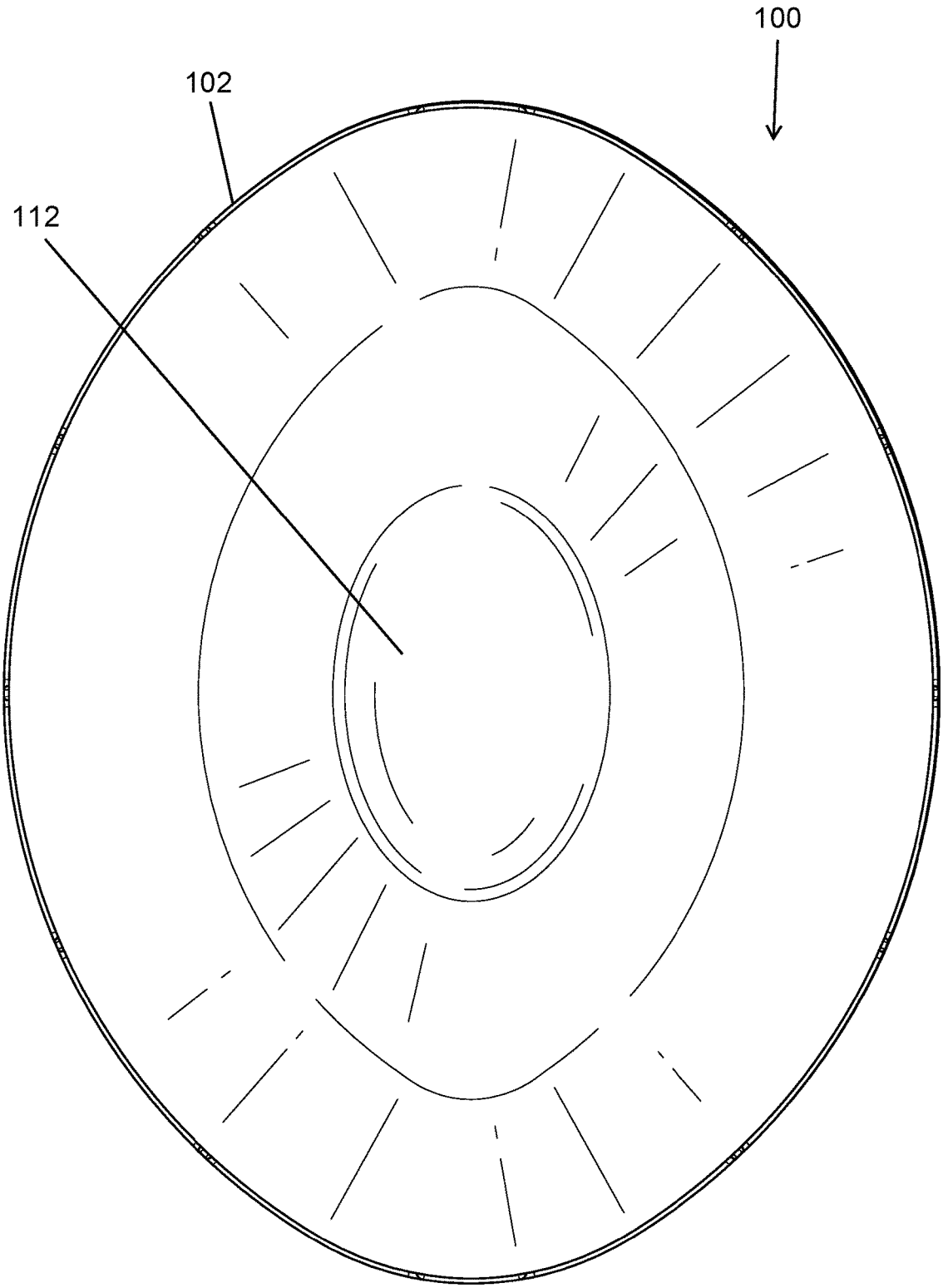
Figure 5:
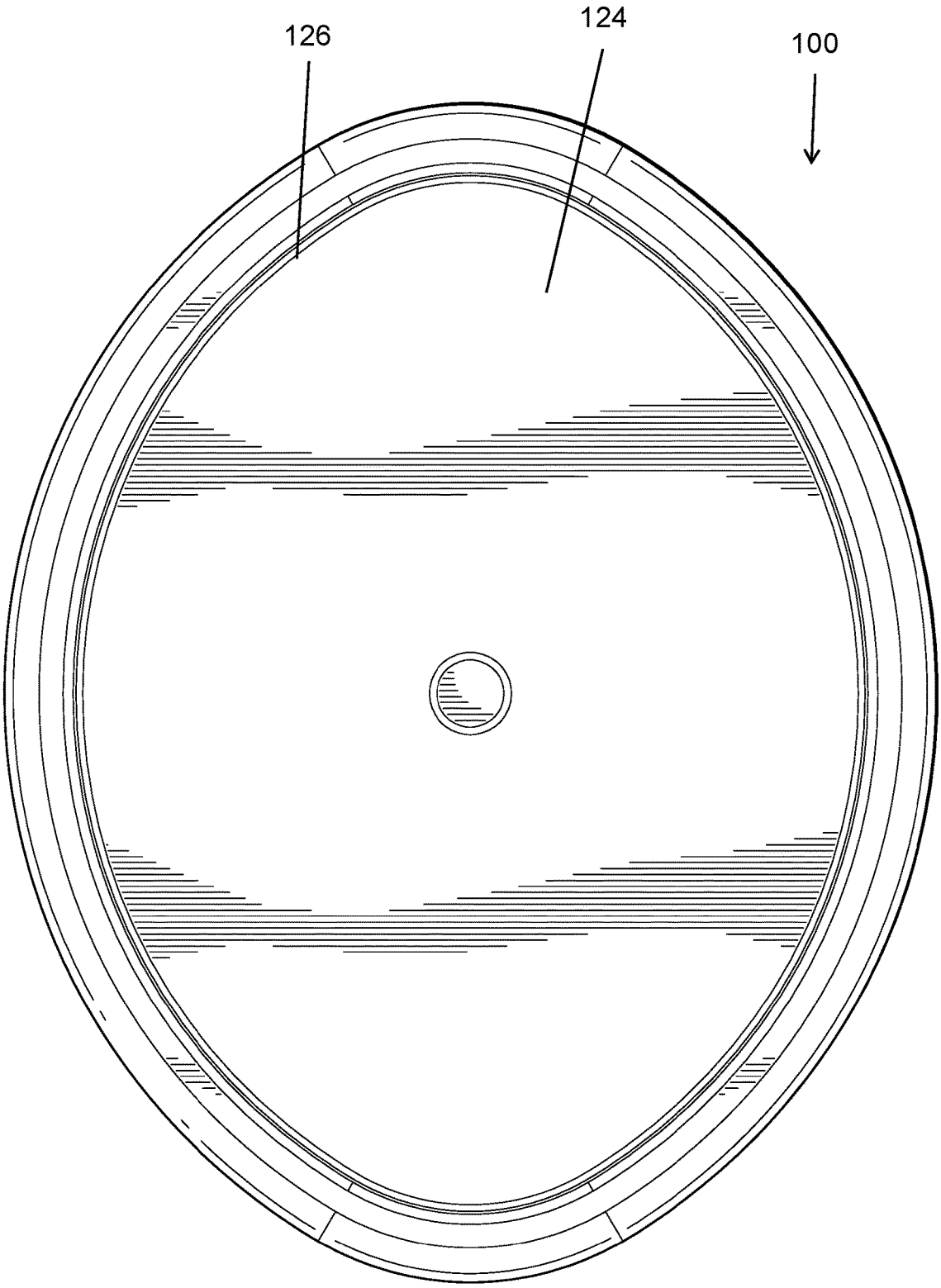
Figure 6:
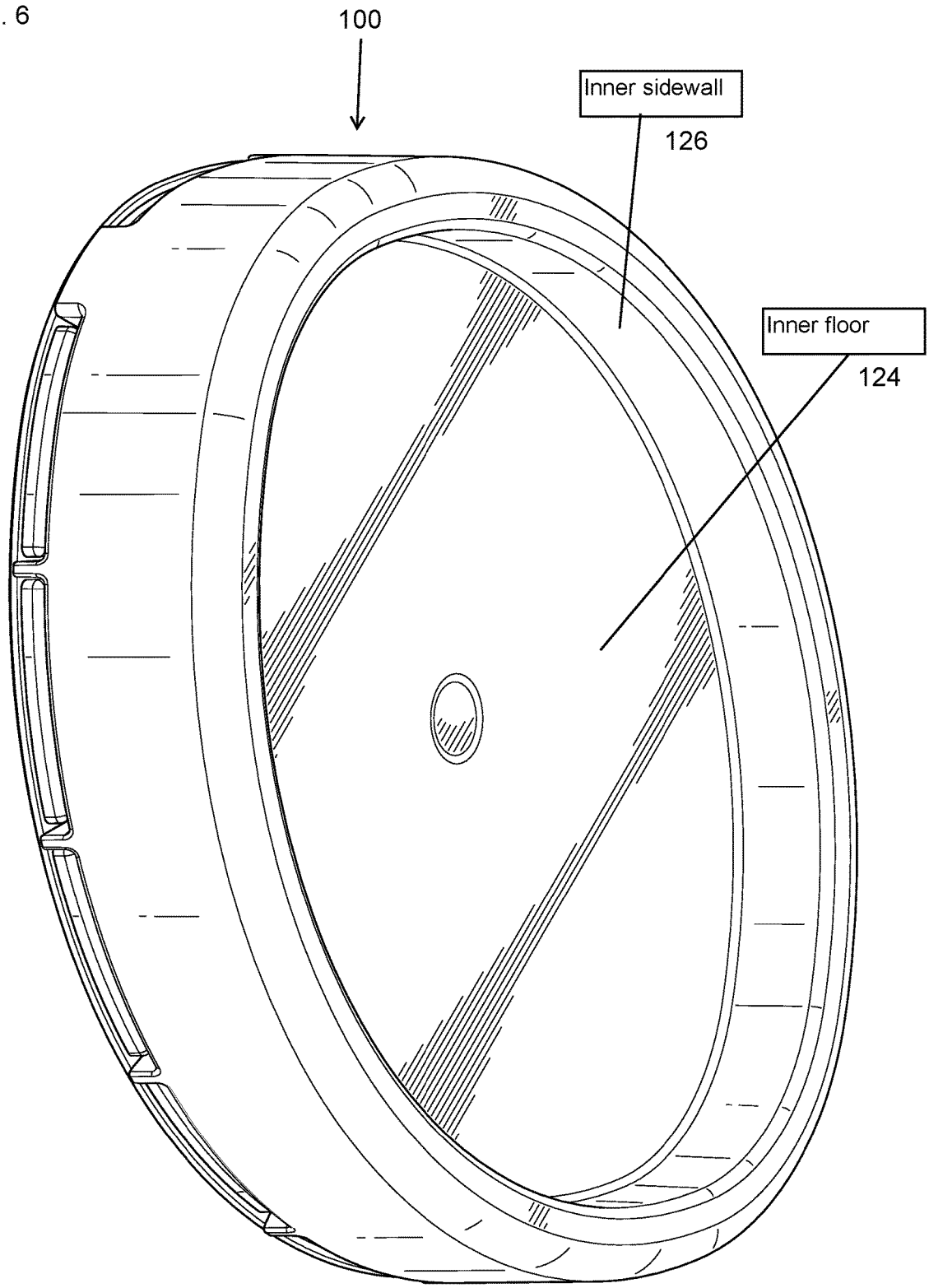

Each of the slots 118 has a floor 120 extending between a pair of vertical partitions 116 such that a U-shaped or C-shaped or V-shaped or W-shaped area is defined (e.g., at least one of the vertical partitions 116 can be acute, obtuse or perpendicular relative to the floor 120). The floor 120 extends up to an outer side of an inner sidewall 126, which contacts (e.g., at a perpendicular, acute, obtuse angle) an inner central floor 124 that faces the inward projection of the inward central dimple 112, as shown in FIG. 8. Note that the inner floor 124 can be lacking as well such that the inward projection of the inward central dimple 112 is exposed. The outer side of the inner sidewall 126 is longitudinally eye-shaped, as shown in FIGS. 5 and 8, although other shapes are possible, whether open-shape or closed-shape, whether symmetrical or asymmetrical, such as a circle, square, rectangle, pentagon, octagon, triangle, trapezoid, or any other polygonal shape. For example, at least one of the slots 118 can have a trapezoidal, square, or rectangular area. The outer side of the inner sidewall 126 structurally extends mimicking the outer side of the outer sidewall 114. The inner sidewall 126 defines an internal area into which the central inward dimple 112 of the lid 102 projects. The internal area can be used for storage, such as of a fluid, a gel, a powder, a physical item, or others. The floor 120 may or may not be coated with a friction enhancing or reducing coating. For example, the friction enhancing coating can be rubber. For example, the friction reducing coating can be polytetrafluoroethylene (PTFE), silicon, or others.

The floor 120 can be level or inclined relative to the outer sidewall 114, whether inward or outward (e.g., the floor 120 can be acute, obtuse or perpendicular relative to the outer sidewall 114). As shown in FIG. 9, this incline can be less than about 90 degrees, less than about 75 degrees, less than about 60 degrees, less than about 50 degrees, less than about 45 degrees, less than about 30 degrees, less than about 15 degrees, less than about 10 degrees, less than about 7 degrees, less than about 5 degrees, less than about 3 degrees, or others including any intermediate values. For example, when the floor 120 is acutely inclined inward toward the center of the case 100 at or less than about 30 degrees relative to the outside sidewall 114, then the artificial lash extension 110 stored therein can be propped up or angled upwards and less likely to fall out during use, such as transport of the case.

The floor 120 can be smooth or rough. For example, the floor 120 can be textured (e.g., parallel lines, intersecting lines) to reduce artificial lash extension 110 movement during use, such as transport of the case 100. The floor 120 can be textured in various ways, such as knurled, hatched, spiked, bumped, or others, whether inward or outward. The floor 120 can be grooved or ridged. For example, the floor 120 can host a plurality of longitudinal projections radially or non-radially projecting outwards (e.g., like rays of sun) toward the outer sidewall 114. For example, the floor 120 can host at least two parallel or non-parallel, rectilinear or non-rectilinear, continuous or discontinuous projections, which can have a U-shaped, C-shaped, D-shaped, B-shaped, W-shaped, V-shaped, or any other shaped projections.

The slots 118 can be equivalent or non-equivalent in volume when the lid 102 is positioned on the body 104 or vice versa. The slots 118 can have identical or non-identical window shape and/or size 122 when the lid 102 is positioned on the body 104 (e.g., vary in length or height). The slots 118 can reduce or not reduce in volume or area or window shape 122 as the slots 118 get closer to corners of the body 104 (e.g., artificial lash extensions 110 can vary in length or width or thickness at center relative to those at corners or artificial lash extensions 110 can be mixed and matched by users). The slots 118 can store an identically sized or structured artificial lash extensions 110, which can be or avoid being of same type. The slots 118 can store non-identically sized or structured artificial lash extensions 110, which may or may not be of same type. For example, the case 100 can store an identically sized or structured artificial lash extensions 110 (e.g., specific artificial lash extension type or identical in length of hairs extending from base or length of base or number of hair clusters per base or hair thickness). For example, a fused bundle of hairs can be between about 30 to about 40 hairs, which can be between about 30-35, which can be between about 31-33.

When the lid 102 is secured onto the body 104 and the slots 118 contain the artificial lash extensions 110, the lid 102 and the body 104 structurally cooperate not to apply undue pressure onto the artificial lash extensions 110 (e.g., protect the curls of the artificial lash extensions 110 and minimize downward pressure from the lid 102) yet structurally cooperate so that the artificial lash extensions 110 do not fall out from the case 100.

FIG. 8 shows an example of the case 100 being open, with the case 100 having the lid 102 and the body 104 detached from each other, as described herein. The lid 102 is opaque, but can be transparent or translucent. The lid 102 has an inner side (e.g., underside) that hosts a central outwardly protruding area 128 that corresponds to the central inwardly protruding dimple 112, as described herein. The central outwardly protruding area 128 centrally hosts the visual indicia 108 corresponding to a type of artificial lash extensions that are stored in this case 100, as described herein. Note that the visual indicia 108 can be non-centrally hosted as well. The central outwardly protruding area 126 can also be non-protruding, such as flat or inwardly dimpled.

The central outwardly protruding area 128 is surrounded by a wall 130 (e.g., continuous, discontinuous, solid, perforated) that extends from the inner side (e.g., perpendicularly, acutely, obtusely) of the lid 102. The wall 130 is longitudinally eye-shaped, although other shapes are possible, whether open-shape or closed-shape, whether symmetrical or asymmetrical, such as a circle, square, rectangle, pentagon, octagon, triangle, trapezoid, or any other polygonal shape.

The wall 130 may be surrounded by an elastic band 132, although a resilient, flexible, deformable, bendable, or non-rigid member is possible. The elastic band 132 may function as a gasket against the artificial lash extensions 110, as explained herein. The elastic band 132 can include rubber or foam or plastic, but other materials are possible, such as an inflatable balloon or a tubular container containing a fluid (e.g., liquid or gas) or sand or powder or beads/spheres (e.g., rigid or flexible or resilient) or others. The elastic band 132 is longitudinally continuous along the perimeter of the wall 130. However, the elastic band 132 can be a plurality of elastic strips spaced apart from each other, such as discontinuous. The elastic band 132 can be shaped as any closed or open shape (e.g., O-shape, C-shape, U-shape, V-shape, J-shape, D-shape, eye-shape, circle, square, triangle, pentagon, hexagon, octagon, polygon, symmetrical, asymmetrical, oval, ellipse, ovoid). The elastic band 132 can be generally closed-shaped, but specifically shapeless (e.g., dynamically changed depending on how held) before mounting over the wall 130 and then specifically shaped when mounted over the wall 130 to shapely correspond to the wall 130. The elastic band 132 can be specifically shaped before mounting over the wall 130 to correspond to the shape of the wall 130. The elastic band 132 can remain in place via elastic friction or inward pressure against the wall 130. The elastic band 132 can be attached or secured to the inner side (e.g., adhering, bonding, mating, hooking, fastening, interlocking, bracketing). The elastic band 132 can be or avoid being visually distinct from the lid 102 (e.g., color, hatching, patterns).

The inner side of the lid 102 hosts a plurality of protrusions 134 longitudinally spaced apart from each other and longitudinally extending around the elastic band 132. The protrusions 134 extend outwardly from the inner side of the lid 102 such that a plurality of hollow receiving portions 144 (e.g., U-shape, V-shape, C-shape) are defined therebetween. However, at both apexes of the inner side of the lid 102, the protrusions 134 define a pair of lift grooves 136 or open spaces (e.g., triangular, V-shaped, trapezoidal) therebetween, which can help in removing the lid 102 from the body 104 or vice versa (e.g., form a grasping area to apply a separation force). The protrusions 134 are unitary with the inner side of the lid 102 (e.g., molded, 3D printed, cast, stamped, routed) and include same material (e.g., plastic, rubber, metal). However, the protrusions 134 can also be attached to the inner side of the lid 102 (e.g., adhering, magnetizing, fastening, interlocking, mating, bonding).

The protrusions 134 can be identical or non-identical to each other in shape or volume per longitudinal side. The protrusions 134 are shaped as blocks (e.g., trapezoidal, cuboid, conical, D-shaped), whether symmetrical or asymmetrical. The protrusions 134 can change in volume or shape per longitudinal side (e.g., protrusions 134 closer to corners are smaller in volume or shape relative to protrusions 134 further from corners).

At least one of the protrusions 134 has an outer side that faces and contacts an artificial lash extension 110 when the lid 102 is positioned on the body 104 or vice versa and the body 104 stores the artificial lash extension 110 in the slot 118. This side has a rough area 138 proximal to the elastic band 132 and a smooth area 140 distal to the elastic band 132. The rough area 138 and the smooth area 140 are immediately adjacent to each other, although the rough area 138 and the smooth area 140 can be separated by an intermediate area. The rough area 138 can be coated with a friction enhancing material (e.g., rubber, plastic, foam) or include a textured portion (e.g., parallel lines, intersecting lines) to help in limiting movement of the artificial lash extension 110 in the slot 118 or from the slot 118 when the rough area 138 contacts the artificial lash extension 110 in the slot 118. The textured portion can be textured in various ways, such as knurled, hatched, spiked, bumped, or others, whether inward or outward. However, note that this side of the protrusion 134 can also lack the smooth area 140 or the rough area 138.

The body 104 includes the inner floor section 124 (e.g., flat, inwardly depressed, outwardly projected) that faces the protruding area 128 of the lid 102. However, the inner floor section 124 can be lacking as well. The inner floor section 124 is opaque, but can be transparent or translucent. The inner floor section 124 is surrounded by the wall 126 from which the partitions 116 extend radially and thereby define the slots 118 storing the artificial lash extensions 110 therein. The wall 126 has a pair of apex partitions 140 (e.g., triangular, V-shaped, trapezoid) that correspond to the lift grooves 136 of the lid 102 or vice versa.

When the case 100 is closed, the body 104 stores the artificial lash extensions 110 in the slots 118 between the partitions 116 and the lid 102 sits or rests on the body 104, which can be securely positioned, as described herein. During such state, the inner wall 130 of the lid 102 is concentrically engaged with the inner wall 126 of the body 104 (e.g., the inner wall 126 of body 104 is concentrically positioned between the elastic band 132 and the inner wall 130 of the lid 102). The partitions 116 of the body are received in the receiving portions 144. The lift grooves 136 face the apex partitions 142. The protrusions 134 face the slots 118 and contact the artificial lash extensions 110, which can be via the rough areas 138 of the inner sides to frictionally engage the artificial lash extensions 110, while ensuring that the artificial lash extensions 110 do not fall out from the slots 118, yet avoid applying or exerting undue pressure onto the artificial lash extensions 110, based on the elastic band 132 dynamically or resiliently or deformably flexing (e.g., like a gasket or a dynamic barrier), especially when the artificial lash extensions 110 are of different types (e.g., vary by length, width, thickness, hair material) or when the artificial lash extensions 110 are not of same type per longitudinal side of the body 104 (e.g., artificial lash extensions proximal 110 to corners differ relative to artificial lash extensions 100 distal from corners). Note that the elastic band 132 can be absent, but the lid 102 is then structured (e.g., angled floors 120 for sufficient clearance between the lid 102 and the artificial lash extensions 110) to avoid applying or exerting undue pressure onto the artificial lash extensions 110, while ensuring that the artificial lash extensions 110 do not fall out from the slots 118. In an embodiment, an adhesive or friction coating, for example, may be disposed on the floor 120 to help prevent the artificial lash extensions 110 from falling out of the slots 118. The amount and type of adhesive, of course, may be such that the artificial lash extensions 110 are not damaged when removed from the slots 118.

The case 100 may be partially or entirely composed of metal, plastic, or some other material (e.g., foam). For example, in some embodiments the case 100 includes a die case metal body (e.g., for strength and durability) having a smooth powder coating (e.g., for aesthetics and improved cleanability), while in other embodiments the case 100 includes a recyclable (i.e., disposable) plastic body that is not intended for significant durations of use (e.g., months or years). Those skilled in the art will recognize that any suitable material may be used. For example, in some embodiments plastic may be desirable because it is recyclable and resistant to the adhesives typically applied to lash fusions before fixation to an individual's natural lashes.

Moreover, the outer surfaces of the case 100 may be substantially smooth and continuous. Thus, the outer surfaces of these components may be substantially free of any gaps, ridges, or fasteners that would make cleaning difficult or that may inadvertently capture artificial lashes.

FIGS. 10-33 show an embodiment of a case where a gasket is separate and distinct from a lid and a body according to this disclosure. A case 200 is similar to the case 100 in size and function, but has some notable differences. In particular, the case 200 has the lid 102 and the body 104 being separate and distinct from a gasket 202, as shown in FIGS. 18, 21-26, and 29-33. Further, the inner central floor 124 is spaced apart from the sidewall 114, as shown in FIGS. 12, 17, 20, 25, 28, and 33, which can be beneficial from usage of less material. Also, the gasket 202 mates with the body 104 or vice versa, as shown in FIGS. 18, 21-26, and 29-33.

The gasket 202 has a floor 204, a sidewall 206, and a plurality of tabs 208. The floor 202 is monolithic, but can be assembled (e.g., puzzle, mated, interlocked, adhered, magnetized, fastened). The sidewall 206 is monolithic, but can be assembled (e.g., puzzle, mated, interlocked, adhered, magnetized, fastened). At least one of the tabs 208 is monolithic, but can be assembled (e.g., puzzle, mated, interlocked, adhered, magnetized, fastened). At least one of the floor 204, the sidewall 206, or at least one of the tabs 208 includes plastic, metal, rubber, foam, alloy, wood, or others. The tabs 208 should be flexible or deformable to maintain lash extensions in the slot 118, as further provided herein.

The floor 204 is eye-shaped, but can be shaped differently, whether open-shape or closed-shaped, whether symmetrical or asymmetrical (e.g., square, rectangle, circle, oval, triangle, pentagon, hexagon, octagon, U-shape, C-shape, D-shape). The sidewall 206 extends from the floor 204 such that an internal cavity 210 is defined thereby. The sidewall 206 is monolithic with the floor 204, but can be assembled therewith (e.g., fastened, mated, interlocked, magnetized). The sidewall 206 is eye-shaped, but can be shaped differently, whether open-shape or closed-shaped, whether symmetrical or asymmetrical (e.g., square, rectangle, circle, oval, triangle, pentagon, hexagon, octagon, U-shape, C-shape, D-shape). As such, the cavity 210 is eye-shaped, but can be shaped differently, whether open-shape or closed-shaped, whether symmetrical or asymmetrical (e.g., square, rectangle, circle, oval, triangle, pentagon, hexagon, octagon, U-shape, C-shape, D-shape). The floor 204 has a central opening 212, but can avoid the central opening 212. The central opening 212 is circular, but can be shaped differently, whether open-shape or closed-shaped, whether symmetrical or asymmetrical (e.g., square, rectangle, circle, oval, triangle, pentagon, hexagon, octagon, U-shape, C-shape, D-shape).

The tabs 208 are spaced apart from each other and radially and cantileveredly extend from the sidewall 206 away from the cavity 210 not over the floor 204 or the cavity 210. For example, at least one of the tabs 208 extends from the sidewall 206 in an L-shaped manner. The tabs 208 can be visible from frontally looking into the windows 122. The tabs 208 are monolithic with the sidewall 206, but can be assembled therewith (e.g., fastened, mated, interlocked, magnetized). The tabs 208 are V-shaped, but can be shaped differently, whether open-shaped or closed-shaped, whether symmetrical or asymmetrical (e.g., I-shaped, L-shaped, U-shaped, C-shaped, W-shaped, M-shaped, D-shaped, S-shaped, J-shape, Y-shaped, P-shaped). For example, since the tabs 208 are V-shaped, each of the tabs 208 has a central apex which can resiliently engage a respective artificial lash extension 110 within a respective slot 118 to resiliently secure the respective lash extension 110 within the respective slot 118.

As shown in FIGS. 18, 21-26, and 29-33, the gasket 202 can be sandwiched between the lid 102 and the body 104 when the lid 102 is coupled to the body 104 and the artificial lash extensions 110 are positioned within the slots 118 and the wall 130 faces, contacts, or engages the floor 204 around the central opening 212, while the floor 204 is positioned between the protruding area 128 of the lid 102 and the floor 124 of the body 104. As such, the tabs 208 extend within the slots 118 between the partitions 116 over the floors 120 such that the tabs 208 resiliently engage the artificial lash extensions 110 within the slots 118, thereby resiliently securing the artificial lash extensions 110 within the slots 118. Therefore, when a user desires to remove an artificial lash extension 110 from a slot 118, whether by hand or via an applicator, as the artificial lash extension 110 is resiliently secured within the slot 118 via a tab 208, the user can pull the artificial lash extension 110 in a direction (e.g., radial, lateral) away from the tab 208 such that the artificial lash extension 110 slides out from the tab 208 and the slot 118. Alternatively or additionally, the user can lift the tab 208 in order to resiliently unsecure the artificial lash extension 110 and then pull the artificial lash extension 110 in a direction (e.g., radial, lateral) away from the tab 208 such that the artificial lash extension 110 slides out from the slot 118. In an embodiment, the lid 102 may be configured to be pressed against the gasket 202 to cause the gasket 20 to be pushed down so that tabs 208 apply pressure to the lash extensions 110 disposed between the tabs 208 and floor 118. If the lid 102 is raised, but not removed from the body 104, then pressure to the gasket 202 may be reduced, thereby resulting in less pressure from the tabs 208 onto the lash extensions 110.

Although the tabs 208 are shown in a one-to-one correspondence with the slots 118, this can vary (e.g., multiple tabs 208 within single slot 118). Further, although the tabs 208 are spaced apart from each other thereby defining the tabs 208, this configuration can vary and there can be a single tab 208 per plurality of slots 118 (e.g., tabs 208 are not spaced apart from each other thereby defining single tab 208). Additionally, note that the inwardly dimpled portion 126 can be axially co-aligned with the central opening 212 and the male portion 214 (e.g., axis of symmetry, axis of rotation).

When the body 104 has a male portion 214 (e.g., projection, column, pedestal), whether internally hollow or solid, then the gasket 202 can mate with the body 104 via the male portion 214 being inserted, which can also include fastening, into the central opening 212, as shown in FIGS. 18, 21-26, and 29-33, or vice versa. However, a reverse is possible as well, where the gasket 202 has a male portion 216 (e.g., column, pedestal), whether internally solid or hollow) and the body 104 has a central opening 218. As such, the gasket 202 can mate with the body 104 via the male portion 216 being inserted, which can include fastening, into the central opening 218, as shown in FIGS. 18, 21-26, and 29-33, or vice versa. Note that the opening 212 or the opening 218 can be non-central as well. As such, the male portion 214 or 216 can be non-central as well.

The gasket 202 can snugly or non-snugly rest within the body 104. As shown in FIGS. 18, 21-26, and 29-33, the sidewall 206 hosts a plurality of mating portions 220. As such, if the mating portions 220 are male (e.g., projection, column, pedestal), then the inner side of the wall 126 has a plurality of female portions 222 (e.g., depressions, openings) that can mate with the mating portions 220. Conversely, if the mating portions 220 are female (e.g., depressions, openings), then the inner side of the wall 126 has a plurality of male portions (e.g., projection, column, pedestal) that can mate with the mating portions 220. As such, this enables the gasket 202 to snugly rest within the body 104. For example, the gasket 202 can snap fit into the body 104 or vice versa. However, if the mating portions 220 are absent, then the gasket 202 can non-snugly (e.g., freely) rest within the body 104. Further, note that due to shaping of the body 104 and the gasket 202, the gasket 202 can still be snug within the body 104. For example, due to eye-shaping of the gasket 202 and the body 104, the gasket 202 can still remain snug and not be able to rotate within the body 104 unless the gasket 202 is removed from the body 104 and then be rotated and then be inserted back. Note that the mating portion 220 can be spaced apart from each other or the mating portions 220 can avoid being spaced apart from each other such that a single mating portion 220 is defined. In an embodiment, the gasket 202 may be part of or connected to the lid 102 so that the case is formed of two or effectively two components (i.e., the body 104 and lid/gasket 102/202).

One embodiment of a method of manufacturing a case for carrying artificial eyelash extensions may include providing a lid, providing a gasket, and providing a body. The lid may be coupled to the body such that the body and the lid define a window. The gasket may be coupled to either the lid or the body between the lid and the body, where the window may be configured to enable a lash extension having a base and a plurality of hairs that extend out of the window as the gasket resiliently contacts the base or the hairs.

This disclosure is was described with reference to FIGS. 1-33, in which some embodiments of this disclosure are shown. This disclosure may, however, be embodied in many different forms and should not be construed as necessarily being limited to the embodiments disclosed herein. Rather, these embodiments are provided so that this disclosure is thorough and complete, and fully conveys various concepts of this disclosure to skilled artisans.

Various terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements can be present, including indirect and/or direct variants. In contrast, when an element is referred to as being "directly connected" or "directly coupled" to another element, there are no intervening elements present.

As used herein, a term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances.

Although the terms first, second, etc. can be used herein to describe various elements, components, regions, layers and/or sections, these elements, components, regions, layers and/or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from the teachings of the present disclosure.

Furthermore, relative terms such as "below," "lower," "above," and "upper" can be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings were turned over, then the elements described as being on the "lower" side of other elements would then be oriented on "upper" sides of the other elements. Similarly, if the device in one of the figures were turned over, elements described as "below" or "beneath" other elements would then be oriented "above" the other elements. Therefore, the example terms "below" and "lower" can encompass both an orientation of above and below.

The terminology used herein is for describing particular example embodiments and is not intended to be necessarily limiting of the present disclosure. As used herein, the singular forms "a," "an" and "the" are intended to include the plural forms as well, unless the context clearly indicates otherwise. Also, as used herein, the term "a" and/or "an" shall mean "one or more," even though the phrase "one or more" is also used herein. The terms "comprises," "includes" and/or "comprising," "including" when used in this specification, specify the presence of stated features, integers, steps, operations, elements, and/or components, but do not preclude the presence and/or addition of one or more other features, integers, steps, operations, elements, components, and/or groups thereof. Furthermore, when the present disclosure states herein that something is "based on" something else, then such statement refers to a basis which may be based on one or more other things as well. In other words, unless expressly indicated otherwise, as used herein "based on" inclusively means "based at least in part on" or "based at least partially on."

Features described with respect to certain example embodiments may be combined and sub-combined in and/or with various other example embodiments. Also, different aspects and/or elements of example embodiments, as disclosed herein, may be combined and sub-combined in a similar manner as well. Further, some example embodiments, whether individually and/or collectively, may be components of a larger system, wherein other procedures may take precedence over and/or otherwise modify their application. Additionally, a number of steps may be required before, after, and/or concurrently with example embodiments, as disclosed herein. Note that any and/or all methods and/or processes, at least as disclosed herein, can be at least partially performed via at least one entity in any manner.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing, and/or other any other types of manufacturing. For example, some manufacturing processes include three dimensional (30) printing, laser cutting, computer numerical control routing, milling, pressing, stamping, vacuum forming, hydroforming, injection molding, lithography, and so forth.

Any and/or all elements, as disclosed herein, can be and/or include, whether partially and/or fully, a solid, including a metal, a mineral, a gemstone, an amorphous material, a ceramic, a glass ceramic, an organic solid, such as wood and/or a polymer, such as rubber, a composite material, a semiconductor, a nanomaterial, a biomaterial and/or any combinations thereof. Any and/or all elements, as disclosed herein, can be and/or include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, opaqueness, luminescence, reflection, phosphorescence, anti-reflection and/or holography, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible, and/or any other combinations thereof. Any and/or all elements, as disclosed herein, can be identical to and/or different from each other in material, shape, size, color and/or any measurable dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

As used herein, the term "about" and/or "substantially" refers to a +/−10% variation from the nominal value/term. Such variation is always included in any given value/term provided herein, whether or not such variation is specifically referred thereto.

If any disclosures are incorporated herein by reference and such disclosures conflict in part and/or in whole with the present disclosure, then to the extent of conflict, and/or broader disclosure, and/or broader definition of terms, the present disclosure controls. If such disclosures conflict in part and/or in whole with one another, then to the extent of conflict, the later-dated disclosure controls.

Although preferred embodiments have been depicted and described in detail herein, skilled artisans can make various modifications, additions, substitutions and the like can be made without departing from this disclosure, and these are, therefore, considered to be within scope of this disclosure, as claimed.

What is claimed is:

1. A case comprising:

a lid;

a body configured to couple to the lid in a first configuration to define a window; and a gasket configured to position between the lid and the body in the first configuration, wherein the gasket is distinct from the lid and the body, wherein the gasket comprises a wall and a plurality of tabs that radially extend from the wall, wherein in the first configuration the window is configured to position a lash extension having a base and a plurality of hairs such that at least a portion of the plurality of hairs extend out of the window as at least one of the plurality of tabs of the gasket resiliently contacts the base or at least some of the plurality of hairs of the lash extension.

2. The case of claim 1, wherein the lid comprises an inner side, wherein in the first configuration the gasket is configured to couple to the inner side of the lid.

3. The case of claim 1, wherein the lid comprises an outer side having a visual indicia disposed thereon, and wherein the visual indicia is an orientation indicia.

4. The case of claim 1, wherein the lash extension is a first lash extension, wherein the base is a first base, wherein the plurality of hairs are a first plurality of hairs, wherein in the first configuration another window is configured to hold a second lash extension comprising a second base and a second plurality of hairs.

5. The case of claim 4, wherein the case is configured to seat the first lash extension and the second lash extension such that the first plurality of hairs and the second plurality of hairs are positioned co-planar.

6. The case of claim 1, wherein the body comprises a floor leading to the window in the first configuration, wherein the floor is configured to support the base and the plurality of hairs of the lash extension when the lid is not coupled to the body, and wherein the floor is inclined.

7. The case of claim 6, wherein the floor is inclined outwardly.

8. The case of claim 1, wherein the body comprises a floor leading to the window in the first configuration, wherein the floor is configured to support the base and the plurality of hairs of the lash extension when the lid is not coupled to the body, wherein the floor has a rough portion.

9. The case of claim 1, wherein a plurality of windows comprising the window are defined by the body and the lid when the body is coupled to the lid in the first configuration.

10. The case of claim 1, wherein the lid comprises an inner side having a lid wall extending therefrom, wherein the case is configured to seat the lash extension such that the base extends between the window and the lid wall, and wherein the gasket extends at least partially between the lid wall and the window in the first configuration.

11. The case of claim 1, wherein the gasket comprises an elastic band.

12. The case of claim 1, wherein the gasket is resilient.

13. The case of claim 1, wherein the gasket is continuous.

14. The case of claim 1, wherein the lid comprises an inner side having a lid wall extending therefrom, wherein the case is configured to seat the lash extension such that the base of the lash extension extends at least partially between the window and the lid wall, wherein the gasket extends at least partially between the lid wall and the window in the first configuration.

15. The case of claim 1, wherein the lid comprises an inner side having a lid wall extending therefrom, wherein the case is configured to seat the lash extension such that the base of the lash extension extends between the window and the lid wall, wherein the gasket extends between the lid wall and the window in the first configuration, and wherein the gasket is specifically shaped before mounting over the lid wall to correspond to a shape of the lid wall.

16. The case of claim 1, wherein the lid comprises an inner side having a lid wall extending therefrom, wherein the case is configured to seat the lash extension such that the base of the lash extension extends between the window and the lid wall, wherein the gasket extends between the lid wall and the window in the first configuration, wherein in the first configuration the gasket is retained in place via an elastic friction against the lid wall or inward pressure against the lid wall.

17. The case of claim 1, wherein the lid comprises an inner side having a lid wall extending therefrom, wherein the case is configured to seat the lash extension such that the base of the lash extension extends between the window and the lid wall, wherein in the first configuration the gasket extends between the lid wall and the window, wherein in the first configuration the gasket is secured to the lid wall.

18. The case of claim 1, wherein the lid comprises a plurality of protrusions spaced apart from each other and extending along the gasket in the first configuration, wherein at least one of the protrusions engages the base or the plurality of hairs in the first configuration, wherein the at least one of the protrusions is positioned between the gasket and the window in the first configuration.

19. The case of claim 18, wherein the at least one of the protrusions comprises an area proximate to the gasket, and wherein the area is configured to frictionally limit a movement of the lash extension when the area contacts the lash extension.

20. The case of claim 1, wherein the case is configured to seat the lash extension such that the plurality of hairs extend out of the window as the gasket resiliently contacts the base or the plurality of hairs.

21. The case of claim 1, wherein the at least one of the tabs has a projection that contacts the base or the plurality of hairs.

22. The case of claim 21, wherein the at least one of the tabs extends from the wall in an L-shape manner.

23. A method of manufacturing a case, the method comprising:

forming a lid;

forming a body configured to couple to the lid in a first configuration to define a window; and forming a gasket configured to position between the lid and the body in the first configuration, wherein the gasket is distinct from the lid and the body, wherein the gasket comprises a wall and a plurality of tabs that radially extend from the wall, wherein in the first configuration the window is configured to position an artificial lash extension having a base and a plurality of hairs such that at least a portion of the plurality of hairs extend out of the window as at least one of the plurality of tabs of the gasket resiliently contacts the base or at least some of the plurality of hairs of the lash extension.

* * * * *